US010759193B2

(12) United States Patent
Goto et al.

(10) Patent No.: US 10,759,193 B2
(45) Date of Patent: Sep. 1, 2020

(54) INK JET RECORDING METHOD AND INK JET RECORDING APPARATUS WITH BRINGING POROUS BODY OF LIQUID ABSORBING MEMBER INTO CONTACT WITH INK IMAGE

(71) Applicant: CANON KABUSHIKI KAISHA, Tokyo (JP)

(72) Inventors: Ryohei Goto, Fujisawa (JP); Fumihiro Goto, Kawasaki (JP); Takumi Otani, Yokohama (JP); Yohei Iwasaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/021,598

(22) Filed: Jun. 28, 2018

(65) Prior Publication Data

US 2019/0009551 A1 Jan. 10, 2019

(30) Foreign Application Priority Data

Jul. 4, 2017 (JP) ..... 2017-131277

(51) Int. Cl.
*B41J 11/00* (2006.01)
*B41M 7/00* (2006.01)
(Continued)

(52) U.S. Cl.
CPC ..... *B41J 11/002* (2013.01); *B41M 5/0256* (2013.01); *B41M 7/00* (2013.01);
(Continued)

(58) Field of Classification Search
CPC ..... B41J 11/002; B41J 2002/012; B41J 2/01; B41M 7/00; B41M 5/0256; B41M 5/00; B41M 5/0047; B41M 5/03; B41M 5/0017
See application file for complete search history.

(56) References Cited

U.S. PATENT DOCUMENTS 7,025,450 B2 4/2006 Wojcik et al.
8,240,839 B2 8/2012 Yamanobe
(Continued)

FOREIGN PATENT DOCUMENTS

EP 3 401 099 A1 11/2018
JP 2001 328248 * 11/2001 ..... B41J 2/01
(Continued)

OTHER PUBLICATIONS

Extended European Search Report dated Nov. 29, 2018, in European Patent Application No. 18181345.2.
(Continued)

*Primary Examiner* — Henok D Legesse
(74) *Attorney, Agent, or Firm* — Venable LLP

(57) ABSTRACT

An ink jet recording method of the present invention includes a step of applying a reaction liquid onto a transfer body, an ink image forming step, a liquid removing step of bringing a porous body of a liquid absorbing member into contact with the ink image on the transfer body to remove 70% by mass or more of the liquid component from the ink image, a transfer step, and a smoothing step of bringing a fixing member into contact with the ink image on the recording medium, heating and pressing the ink image at a temperature not less than the softening point of the resin to smooth the surface of the ink image, and releasing the heated and pressed ink image from the fixing member at a temperature less than the softening point of the resin.

18 Claims, 9 Drawing Sheets

(51) Int. Cl.

| | |
|---|---|
| ***B41M 5/025*** | (2006.01) |
| *B41J 2/01* | (2006.01) |
| *B41M 5/03* | (2006.01) |
| *B41M 5/00* | (2006.01) |

(52) U.S. Cl.
CPC ..... *B41J 2002/012* (2013.01); *B41M 5/00* (2013.01); *B41M 5/0047* (2013.01); *B41M 5/03* (2013.01)

(56) References Cited

U.S. PATENT DOCUMENTS

| | | | | |
|---|---|---|---|---|
| 9,527,314 | B2 | 12/2016 | Moriguchi et al. | |
| 9,656,459 | B2 | 5/2017 | Kuwabara et al. | |
| 9,707,751 | B2 | 7/2017 | Nishitani et al. | |
| 9,925,802 | B2 | 3/2018 | Nishitani et al. | |
| 2006/0066662 | A1 | 3/2006 | Kadomatsu et al. | |
| 2006/0164487 | A1* | 7/2006 | Kadomatsu ..... | B41J 11/002 347/102 |
| 2006/0232624 | A1 | 10/2006 | Inoue | |
| 2008/0006176 | A1* | 1/2008 | Houjou ..... | C09D 11/322 106/31.13 |
| 2009/0175663 | A1* | 7/2009 | Taniuchi ..... | B41J 2/0057 399/320 |
| 2016/0303847 | A1 | 10/2016 | Soma et al. | |

FOREIGN PATENT DOCUMENTS

| | | | |
|---|---|---|---|
| JP | 2007-513810 | A | 5/2007 |
| JP | 2009-000915 | A | 1/2009 |
| JP | 2009-226907 | A | 10/2009 |
| JP | 2010-005815 | A | 1/2010 |

OTHER PUBLICATIONS

U.S. Appl. No. 16/017,123, Kanako Soma, Ryohei Goto, Tom Ohnishi, filed Jun. 25, 2018.
U.S. Appl. No. 16/021,622, Eisuke Nishitani, Keiichirou Takeuchi, Akira Morita, Kanako Soma, Takumi Otani, Fumihiro Goto, Koichiro Nakazawa, filed Jun. 28, 2018.
U.S. Appl. No. 16/026,202, Atsushi Sakamoto, Satoshi Masuda, Yoshiyuki Honda, Toru Yamane, Kyosuke Deguchi, Ryosuke Hirokawa, Toru Ohnishi, Akihiro Mouri, Noboru Toyama, Toshimori Miyakoshi, Hiroaki Motooka, Ryohei Goto, filed Jul. 3, 2018.

* cited by examiner

INK JET RECORDING METHOD AND INK JET RECORDING APPARATUS WITH BRINGING POROUS BODY OF LIQUID ABSORBING MEMBER INTO CONTACT WITH INK IMAGE

BACKGROUND OF THE INVENTION

Field of the Invention

The present invention relates to an ink jet recording method and an ink jet recording apparatus.

Description of the Related Art

Ink jet recording methods include a method in which an ink containing resin particles is applied to a recording medium, then liquid components in the ink are removed, and a heating and pressing means is used to heat and press the recording medium to form a film of the resin particles contained in the ink on the recording medium, thereby forming an image.

Japanese Patent Application Laid-Open No. 2010-5815 discloses an image forming method that prevents offset of an ink to a fixing member or curling of a recording medium to enable high quality image formation. In this method, dry air is blown to an ink layer on a recording medium to control the residual water amount derived from the ink, and then the ink layer is fixed while heated and pressed by a heat roller. Japanese Patent Application Laid-Open No. 2007-513810 discloses a fixing means that gives highly glossy images while suppressing paper swelling at the time of fixation. In this method, infrared light is applied to a recording medium immediately after image formation to remove liquid components, then the image on the recording medium is heated and pressed and then cooled to solidify the ink while being in close contact with a belt, and the image is released from the belt.

SUMMARY OF THE INVENTION

The present invention is directed to provide an ink jet recording method and an ink jet recording apparatus capable of maintaining the glossiness immediately after fixation even when time passes.

An aspect of the present invention provides an ink jet recording method including a step of applying a reaction liquid onto a transfer body, an ink image forming step of applying, onto the transfer body, an ink containing a resin having a softening point and a liquid component to form an ink image, a liquid removing step of bringing a porous body included in a liquid absorbing member into contact with the ink image on the transfer body to remove at least some of the liquid component from the ink image, a transfer step of transferring the ink image from which at least some of the liquid component is removed, from the transfer body to a recording medium, and a smoothing step of bringing a fixing member into contact with the ink image on the recording medium, heating and pressing the ink image at a temperature not less than the softening point of the resin to smooth a surface of the ink image, and releasing the heated and pressed ink image from the fixing member at a temperature less than the softening point of the resin.

In the liquid removing step, a removal rate of the liquid component is 70% by mass or more.

Another aspect of the present invention provides an ink jet recording method including a step of applying a reaction liquid onto a recording medium, an ink image forming step of applying, onto the recording medium, an ink containing a resin having a softening point and a liquid component to form an ink image, a liquid removing step of bringing a porous body included in a liquid absorbing member into contact with the ink image on the recording medium to remove at least some of the liquid component from the ink image, and a smoothing step of bringing a fixing member into contact with the ink image from which at least some of the liquid component is removed on the recording medium, heating and pressing the ink image at a temperature not less than the softening point of the resin to smooth a surface of the ink image, and releasing the heated and pressed ink image from the fixing member at a temperature less than the softening point of the resin.

In the liquid removing step, a removal rate of the liquid component is 70% by mass or more.

Still another aspect of the present invention provides an ink jet recording apparatus including a transfer body, a reaction liquid applying unit configured to apply a reaction liquid onto the transfer body, an ink image forming unit configured to apply, onto the transfer body, an ink containing a resin having a softening point and a liquid component to form an ink image, a liquid absorbing unit including a liquid absorbing member having a porous body configured to come into contact with the ink image on the transfer body to absorb at least some of the liquid component from the ink image, a transfer unit configured to transfer the ink image from which at least some of the liquid component is removed, from the transfer body to a recording medium, and a fixing unit including a fixing member configured to come into contact with the ink image on the recording medium, to smooth the ink image by heat and pressure, and to release the ink image.

In the ink jet recording apparatus, the fixing unit includes a heating unit configured to heat the fixing member to a temperature not less than the softening point of the resin and a cooling and releasing unit configured to cool the fixing member to a temperature less than the softening point of the resin and to release the ink image, and the liquid absorbing unit is configured to absorb and remove such an amount of the liquid component as to give a removal rate of 70% by mass or more of the liquid component in the ink image.

Still another aspect of the present invention provides an ink jet recording apparatus including a reaction liquid applying unit configured to apply a reaction liquid onto a recording medium, an ink image forming unit configured to apply, onto the recording medium, an ink containing a resin having a softening point and a liquid component to form an ink image, a liquid absorbing unit including a liquid absorbing member having a porous body configured to come into contact with the ink image on the recording medium to absorb at least some of the liquid component from the ink image, and a fixing unit including a fixing member configured to come into contact with the ink image on the recording medium, to smooth the ink image by heat and pressure, and to release the ink image.

In the ink jet recording apparatus, the fixing unit includes a heating unit configured to heat the fixing member to a temperature not less than the softening point of the resin and a cooling and releasing unit configured to cool the fixing member to a temperature less than the softening point of the resin and to release the ink image, and the liquid absorbing unit is configured to absorb and remove such an amount of the liquid component as to give a removal rate of 70% by mass or more of the liquid component in the ink image.

Further features of the present invention will become apparent from the following description of exemplary embodiments with reference to the attached drawings.

DESCRIPTION OF THE EMBODIMENTS

Figure 1:
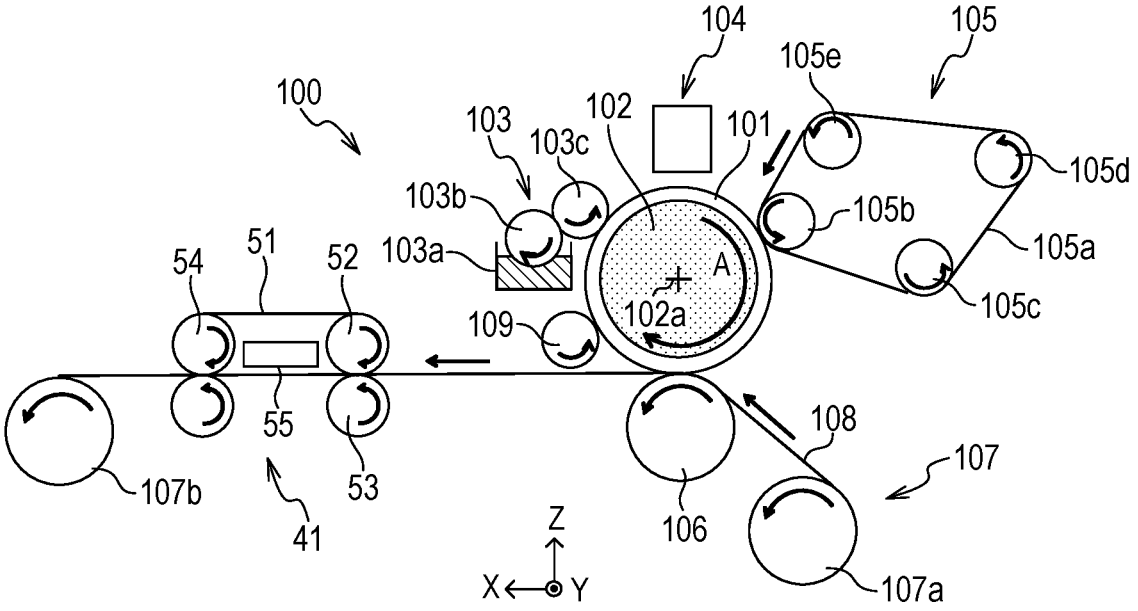
FIG. 1 is a schematic view showing an exemplary structure of a transfer type ink jet recording apparatus according to an embodiment of the present invention.

Preferred embodiments of the present invention will now be described in detail in accordance with the accompanying drawings.

In the method disclosed in Japanese Patent Application Laid-Open No. 2010-5815, an image is released from a heat roller before ink components (for example, resins) are solidified in the image pressed by the heat roller, thus the image has a roughened surface, and an image having a high glossiness is difficult to yield. In the method disclosed in Japanese Patent Application Laid-Open No. 2007-513810, an image is released from a belt after the solidification of an ink, thus immediately after the release, surface properties of the belt can be maintained to yield an image having a high glossiness. However, the method disclosed in Japanese Patent Application Laid-Open No. 2007-513810 requires special papers for achieving gloss and fails to achieve high gloss on plain papers.

By combining the image formation disclosed in Japanese Patent Application Laid-Open No. 2010-5815 with the fixation disclosed in Japanese Patent Application Laid-Open No. 2007-513810, an image having a high glossiness could be formed on plain papers. However, the study by the inventors of the present invention has revealed that the image has a high glossiness immediately after image formation, but as time passes after fixation, the expressed glossiness may deteriorate to fail to give a highly glossy image finally.

The present invention will now be described in detail with reference to preferred embodiments. In the present invention, the "glossiness" of an image is an image clarity C (2) (%) determined with an image clarity meter (manufactured by Suga Test Instruments, ICM-1T) at an optical comb width of 2 mm.

An ink jet recording method pertaining to the present embodiment includes a step of applying a reaction liquid onto a transfer body. The method also includes a step of applying, onto the transfer body, an ink containing a resin having a softening point and a liquid component to form an ink image. The method further includes a liquid removing step of bringing a porous body included in a liquid absorbing member into contact with the ink image on the transfer body to remove at least some of the liquid component from the ink image, thereby forming an ink image after liquid removal. The method further includes a step of transferring the ink image after liquid removal from the transfer body to a recording medium. The method further includes a smoothing step (also called a fixation step). In the smoothing step, a fixing member is brought into contact with the ink image after liquid removal on the recording medium, and the ink image is heated and pressed at a temperature not less than the softening point of the resin component to smooth the surface of the ink image after liquid removal. The heated and pressed ink image is then released (also called "separated") from the fixing member at a temperature less than the softening point of the resin component. In the liquid removing step, the removal rate of the liquid component is 70% by mass or more.

According to the above embodiment, in the liquid removing step, the porous body comes into contact with the ink image or comes into contact with and presses against the ink image, and thus solid components such as resin particles in the ink image come close to each other. In the smoothing step, the solid components including the softened resin are likely to follow the fixing member, and a non-solid component region is unlikely to be formed. A non-solid component region immediately after smoothing is filled with a liquid component that moves more freely than solid components, and thus a resulting image temporarily has a high glossiness. As time passes, the liquid component evaporates or infiltrates into a recording medium to form voids (pores). The inventors of the present invention have supposed that pores having a comparatively large diameter (for example, about 1 μm or more) cause a larger difference in refractive index between air present in the pores and the solid components, and thus light is likely to scatter on the surface layer of the image to reduce the glossiness. On the basis of this assumption, the inventors of the present invention have assumed that in order to suppress the reduction in glossiness, it is effective to remove a liquid component in an ink image when the ink image still contains a large amount of the liquid component and solid components are comparatively movable and to reduce the distance between the solid components. The inventors of the present invention have found that in order to suppress the formation of pores in an image surface layer, it is important to remove the liquid component at a removal rate of 70% by mass or more relative to the total mass of the liquid component in an ink image before liquid removal (i.e. before removing the liquid component by the liquid removing step) in the liquid removing step. The removal rate of the liquid component is more preferably 80% by mass or more.

An ink jet recording apparatus pertaining to an embodiment of the present invention will now be described with reference to drawings.

The ink jet recording apparatus of the embodiment includes two types of apparatuses. One is an ink jet recording apparatus in which an ink is ejected onto a transfer body as a liquid receiving medium (i.e., a transfer body or a recording medium directly receiving an ejected ink) to form an ink image, then a liquid is removed from the ink image by a liquid absorbing member, and the ink image after liquid absorption is transferred to a recording medium. The other is an ink jet recording apparatus in which an ink image is formed on a recording medium such as paper and fabric as a liquid receiving medium, and a liquid is absorbed from the ink image on the recording medium by a liquid absorbing member. In the present invention, the former ink jet recording apparatus is called a transfer type ink jet recording apparatus, and the latter ink jet recording apparatus is called a direct drawing type ink jet recording apparatus, hereinafter for convenience.

Each ink jet recording apparatus will next be described.

(Transfer Type Ink Jet Recording Apparatus)

FIG. 1 is a schematic view showing an exemplary schematic structure of a transfer type ink jet recording apparatus 100 in the embodiment. The recording apparatus is a sheet-feeding ink jet recording apparatus in which an ink image is transferred from a transfer body 101 to a recording medium 108 to produce a recorded product. In the present embodiment, X-direction, Y-direction and Z-direction represent the width direction (entire length direction), the depth direction and the height direction, respectively, of the ink jet recording apparatus 100. The recording medium 108 is conveyed in the X-direction.

As shown in FIG. 1, the transfer type ink jet recording apparatus 100 of the present invention includes a transfer body 101, a reaction liquid applying device 103, an ink applying device 104, a liquid absorbing device 105, a pressing member for transfer 106 and a fixing device 41. The transfer body 101 is supported by a support member 102. The reaction liquid applying device (reaction liquid applying unit) 103 applies, on the transfer body 101, a reaction liquid that reacts with color inks. The ink applying device (ink image forming unit) 104 includes an ink jet head that applies color inks onto the transfer body 101 with the reaction liquid to form, on the transfer body, an ink image as an image by inks. The liquid absorbing device 105 includes a liquid absorbing member having a porous body, and the liquid absorbing member comes into contact with the ink image to absorb a liquid component from the ink image on the transfer body. The pressing member for transfer (transfer device) 106 is a pressing member for transfer for transferring the ink image after liquid component removal on the transfer body onto a recording medium 108 such as paper. The fixing device (fixing unit) 41 smooths and fixes the image on the recording medium.

The transfer type ink jet recording apparatus 100 may include a transfer body cleaning member 109 for cleaning the surface of the transfer body 101 after transfer, as needed. The transfer body 101, the reaction liquid applying device 103, the ink jet head of the ink applying device 104, the liquid absorbing device 105 and the transfer body cleaning member 109 naturally have sufficient lengths in the Y-direction for a recording medium 108 to be used.

The transfer body 101 rotates around a rotating shaft 102*a* of the support member 102 as the center in the arrow direction A in FIG. 1. As the support member 102 rotates, the transfer body 101 moves. Onto the moving transfer body 101, the reaction liquid applying device 103 applies a reaction liquid, and the ink applying device 104 applies inks sequentially, forming an ink image on the transfer body 101. As the transfer body 101 moves, the ink image formed on the transfer body 101 moves to a position at which a liquid absorbing member 105*a* included in the liquid absorbing device 105 comes into contact.

The liquid absorbing member 105*a* of the liquid absorbing device 105 synchronizes with the rotation of the transfer body 101 and moves (rotates) in the arrow direction. The ink image formed on the transfer body 101 undergoes the state of contact with the moving liquid absorbing member 105*a*. During the contact state, the liquid absorbing member 105*a* removes the liquid component from the ink image on the transfer body. In the contact state, the liquid absorbing member 105*a* is particularly preferably pressed against the transfer body 101 at a certain pressing force (contact pressure) for helping the liquid absorbing member 105*a* to function effectively.

The removal of a liquid component can be expressed from a different point of view as concentrating the ink included in an image (ink image) formed on the transfer body. The concentrating an ink means that as the liquid component contained in an ink decreases, the proportion of the solid component such as coloring materials and resins contained in the ink increases relative to the liquid component.

The ink image after liquid component removal has a higher ink concentration than the ink image before liquid removal and is conveyed by the transfer body 101 to a transfer unit at which the ink image comes into contact with a recording medium 108 conveyed by a recording medium conveyance device 107. The transfer unit includes a pressing member for transfer 106 for transferring an image onto a recording medium 108. When the pressing member 106 presses against the transfer body 101 while the ink image after liquid removal is in contact with the recording medium 108, the ink image is transferred onto the recording medium 108. The ink image after transfer onto the recording medium 108 is a reverse image of the ink image before liquid removal and the ink image after liquid removal.

In the present embodiment, a reaction liquid is applied onto the transfer body, and then an ink is applied to form an image. Hence, in a non-image region in which an image is not formed by an ink, the reaction liquid is not reacted with the ink to be left. In the apparatus, the liquid absorbing member 105*a* comes into contact with not only an image but also an unreacted reaction liquid and removes the liquid component in the reaction liquid together.

Although the above description expresses that the liquid component is removed from an image (ink image), the expression is not limited to the removal of the liquid component only from an image but means that the liquid component is removed at least from an image on the transfer body.

The liquid component may be any liquid component that does not have a certain shape but have flowability and an almost constant volume. Examples of the liquid component include water and organic solvents contained in an ink or a reaction liquid.

Components constituting the transfer type ink jet recording apparatus of the embodiment will next be described.

<Transfer Body>

The transfer body 101 includes a surface layer having an image formation surface. As the material of the surface layer, various materials such as resins and ceramics can be appropriately used, but a material having a high compressive elastic modulus is preferred from the viewpoint of durability and the like. Specific examples include acrylic resins, acrylic silicone resins, fluorine-containing resins and condensates prepared by condensation of a hydrolyzable organic silicon compound. In order to improve the wettability of a reaction liquid, transferability and the like, a surface treatment may be performed. Examples of the surface treatment include flame treatment, corona treatment, plasma treatment, polishing treatment, roughening treatment, active energy ray-irradiation treatment, ozone treatment, surfactant treatment and silane coupling treatment. These treatments may be performed in combination. The surface layer may have any surface shape.

The transfer body preferably includes a compressible layer having such a function as to absorb pressure fluctuations. A provided compressible layer absorbs deformation to disperse local pressure fluctuations, and satisfactory transferability can be maintained even during high speed printing. Examples of the material of the compressible layer include acrylonitrile-butadiene rubber, acrylic rubber, chloroprene rubber, urethane rubber and silicone rubber. When such a rubber material is molded, it is preferred that predetermined amounts of a vulcanizing agent, a vulcanization accelerator and the like be added, and a foaming agent, hollow particles or a filler such as sodium chloride be further added, as needed, to form a porous material. In such a porous compressible layer, bubble portions are compressed with volume changes against various pressure fluctuations, thus deformation except in a compression direction is small, and more stable transferability and durability can be achieved. The porous rubber material includes a material having a continuous pore structure in which pores are connected to each other and a material having a closed pore structure in which pores are independent of each other. In the present invention, either of the structures may be used, or the structures may be used in combination.

The transfer body preferably further includes an elastic layer between the surface layer and the compressible layer. As the material of the elastic layer, various materials such as resins and ceramics can be appropriately used. From the viewpoint of processing characteristics and the like, various elastomer materials and rubber materials are preferably used. Specific examples include fluorosilicone rubber, phenylsilicone rubber, fluororubber, chloroprene rubber, urethane rubber, nitrile rubber, ethylene-propylene rubber, natural rubber, styrene rubber, isoprene rubber, butadiene rubber, ethylene/propylene/butadiene copolymers and nitrile-butadiene rubber. Specifically, silicone rubber, fluorosilicone rubber and phenylsilicone rubber, which have a small compress set, are preferred from the viewpoint of dimensional stability and durability. These materials have a small temperature change in elastic modulus, and thus are preferred from the viewpoint of transferability.

Between the layers constituting the transfer body (the surface layer, the elastic layer and the compressible layer), various adhesives or double-sided adhesive tapes may be interposed in order to fix/hold the layers. The transfer body may also include a reinforcing layer having a high compressive elastic modulus in order to suppress lateral elongation when installed in an apparatus or to maintain resilience. A woven fabric may be used as the reinforcing layer. The transfer body can be prepared by combination of any layers made from the above materials.

The size of the transfer body can be freely selected depending on the size of an intended print image. The transfer body may have any shape, and specific examples of the shape include a sheet shape, a roller shape, a belt shape and an endless web shape.

<Support Member>

The transfer body 101 is supported on a support member 102. As the supporting manner of the transfer body, various adhesives or double-sided adhesive tapes may be used. Alternatively, a transfer body attached with an installing member made from a metal, ceramics, a resin or the like may be supported on the support member 102 by using the installing member.

The support member 102 is required to have a certain structural strength from the viewpoint of conveyance accuracy or durability. As the material for the support member, metals, ceramics, resins and the like are preferably used. Specifically, aluminum, iron, stainless steel, acetal resins, epoxy resins, polyimide, polyethylene, polyethylene terephthalate, nylon, polyurethane, silica ceramics and alumina ceramics are preferably used in terms of the rigidity capable of withstanding the pressure at the time of transfer, dimensional accuracy and reduction of the inertia during operation to improve the control responsivity. Combination use of these materials is also preferred.

<Reaction Liquid Applying Device>

The ink jet recording apparatus of the embodiment includes a reaction liquid applying device 103 for applying a reaction liquid onto the transfer body 101. When coming into contact with an ink, the reaction liquid reduces the flowability of the ink and/or some ink components on a liquid receiving medium to suppress bleeding or beading when an ink image is formed. Specifically, a reactant (also called an ink-viscosity-increasing component) contained in the reaction liquid comes into contact with a coloring material, a resin or the like as a component in an ink, and is chemically reacted with or physically adsorbed to the component. This can cause a viscosity increase of the whole ink or cause a local viscosity increase due to aggregation of some components constituting an ink, such as a coloring material, thereby reducing the flowability of the ink and/or some ink components. The reaction liquid applying device 103 in FIG. 1 shows the case of a gravure offset roller including a reaction liquid storage unit 103*a* for storing a reaction liquid and reaction liquid applying members 103*b*, 103*c* for applying the reaction liquid in the reaction liquid storage unit 103*a* onto the transfer body 101.

The reaction liquid applying device may be any device capable of applying a reaction liquid onto a liquid receiving medium, and conventionally known various devices can be appropriately used. Specific examples of the device include a gravure offset roller, an ink jet head, a die coating device (die coater) and a blade coating device (blade coater). The application of a reaction liquid by the reaction liquid applying device may be performed either before the application of an ink or after the application of an ink as long as the reaction liquid can be mixed (reacted) with an ink on a liquid receiving medium. Preferably, the reaction liquid is applied before the application of an ink. The application of a reaction liquid before the application of an ink enables suppression of bleeding, which is caused by mixing of inks applied adjacent to each other, or beading, which is caused by pulling of a previously applied ink by a subsequently applied ink, at the time of image recording by the ink jet system.

<Reaction Liquid>

Components constituting the reaction liquid applicable in the present embodiment will next be described in detail.

(Reactant)

The reaction liquid causes aggregation of a component having an anionic group (a resin, a self-dispersible pigment, for example) in an ink when coming into contact with the ink, and contains a reactant. Examples of the reactant include cationic components such as a polyvalent metal ion and a cationic resin and organic acids.

Examples of the polyvalent metal ion include divalent metal ions such as $Ca^{2+}$, $Cu^{2+}$, $Ni^{2+}$, $Mg^{2+}$, $Sr^{2+}$, $Ba^{2+}$ and $Zn^{2+}$ and trivalent metal ions such as $Fe^{3+}$, $Cr^{3+}$, $Y^{3+}$ and $A^{3+}$. To allow the reaction liquid to contain a polyvalent metal ion, a polyvalent metal salt (optionally a hydrate) formed by bonding a polyvalent metal ion with an anion can be used. Examples of the anion include inorganic anions such as $Cl^-$, $Br^-$, $I^-$, $ClO^-$, $ClO_2^-$, $ClO_3^-$, $ClO_4^-$, $NO_2^-$, $NO_3^-$, $SO_4^{2-}$, $CO_3^{2-}$, $HCO_3^-$, $PO_4^{3-}$, $HPO_4^{2-}$ and $H_2PO_4^-$; and organic anions such as $HCOO^-$, $(COO^-)_2$, $COOH(COO^-)$, $CH_3COO^-$, $C_2H_4(COO^-)_2$, $C_6H_5COO^-$, $C_6H_4(COO^-)_2$ and $CH_3SO_3^-$. When a polyvalent metal ion is used as the reactant, the content (% by mass) in terms of polyvalent metal salt in the reaction liquid is preferably 1.00% by mass or more to 20.00% by mass or less relative to the total mass of the reaction liquid.

The reaction liquid containing an organic acid has a buffer capacity in an acidic region (a pH of less than 7.0, preferably a pH of 2.0 to 5.0), thus makes an anionic group of a component present in an ink into an acid form, and causes the component to aggregate. Examples of the organic acid include monocarboxylic acids such as formic acid, acetic acid, propionic acid, butyric acid, benzoic acid, glycolic acid, lactic acid, salicylic acid, pyrrole carboxylic acid, furan carboxylic acid, picolinic acid, nicotinic acid, thiophene carboxylic acid, levulinic acid and coumaric acid and salts thereof; dicarboxylic acids such as oxalic acid, malonic acid, succinic acid, glutaric acid, adipic acid, maleic acid, fumaric acid, itaconic acid, sebacic acid, phthalic acid, malic acid and tartaric acid and salts and hydrogen salts thereof; tricarboxylic acids such as citric acid and trimellitic acid and salts and hydrogen salts thereof; and tetracarboxylic acids such as pyromellitic acid and salts and hydrogen salt thereof. The content (% by mass) of the organic acid in the reaction liquid is preferably 1.00% by mass or more to 50.00% by mass or less.

Examples of the cationic resin include resins having a primary to tertiary amine structure and resins having a quaternary ammonium salt structure. Specific examples include resins having such a structure as vinylamine, allylamine, vinylimidazole, vinylpyridine, dimethylaminoethyl methacrylate, ethyleneimine and guanidine. In order to improve the solubility in the reaction liquid, the cationic resin may be used in combination with an acidic compound, or the cationic resin may be subjected to quaternarization treatment. When a cationic resin is used as the reactant, the content (% by mass) of the cationic resin in the reaction liquid is preferably 1.00% by mass or more to 10.00% by mass or less relative to the total mass of the reaction liquid.

(Components Other than Reactant)

As components other than the reactant, those substantially the same as the aqueous media and additional additives exemplified above as usable in the ink can be used.

<Ink Applying Device>

The ink jet recording apparatus of the embodiment includes an ink applying device 104 for applying an ink to the transfer body 101. The ink is applied to the transfer body so as to at least partly overlap with a region in which a reaction liquid is applied. On the transfer body, the reaction liquid and the ink are mixed, and the reaction liquid and the ink form an ink image. The liquid absorbing device 105 then absorbs a liquid component from the ink image.

In the present embodiment, an ink jet head is used as the ink applying device for applying an ink. Examples of the ink jet head include a device that causes film boiling of an ink by an electrothermal converter to form bubbles and ejects the ink, a device that ejects an ink by an electromechanical converter and a device that ejects an ink by using static electricity. In the present embodiment, a known ink jet head can be used. Specifically, the device using an electrothermal converter can be suitably used, particularly from the viewpoint of high-density printing at high speed. To record an image, the head applies an intended amount of an ink to an intended position upon receiving an image signal.

In the present embodiment, the ink jet head is a full-line head extending in the Y-direction, and nozzles are arranged in a range covering the width of an image recording region on a usable recording medium with the maximum size. The ink jet head has, on the bottom face thereof (the transfer body 101 side), an ink ejection face having nozzle openings. The ink ejection face faces the surface of the transfer body 101, and a small clearance (about several millimeters) is interposed therebetween.

The ink application amount can be expressed by an image data density or an ink thickness, for example. In the present embodiment, the mass of each ink dot is multiplied by the number of dots applied, and the result is divided by a printed area to give an average as the ink application amount ($g/m^2$). The maximum ink application amount in an image region means an ink application amount in at least an area of 5 $mm^2$ or more within a region used as information of a liquid receiving medium from the viewpoint of removing the liquid component in an ink.

The ink applying device 104 may include a plurality of ink jet heads in order to apply various color inks onto a liquid receiving medium. For example, when a yellow ink, a magenta ink, a cyan ink and a black ink are used to form a color image, the ink applying device includes four ink jet heads that each ejects a corresponding ink of the four inks onto a liquid receiving medium. These ink jet heads are arranged in the X-direction.

The ink applying device may include an ink jet head for ejecting a clear ink that contains no coloring material, or contains a coloring material at an extremely small content, and is substantially transparent. The clear ink can be used to form an ink image together with the reaction liquid and the color inks. For example, the clear ink can be used to improve the glossiness of an image. To express a glossy appearance on an image after transfer, appropriate resin components can be added, and the ejection position of the clear ink can be adjusted. The clear ink is preferably present more closely to the surface layer than the color ink in a final recorded product, and thus the clear ink is applied onto the transfer body 101 before the application of color inks in a transfer type recording apparatus. Hence, in the moving direction of the transfer body 101 facing the ink applying device 104, the ink jet heads for a clear ink can be provided at the upstream side of the ink jet head for color inks.

Separately from the clear ink for gloss, a clear ink can be used to improve the transferability of an image from the transfer body 101 to a recording medium. For example, a large amount of a component for exhibiting higher tackiness than that of color inks is added, and a resulting clear ink can be applied to the color inks on the transfer body 101 and thus can be used as a transferability improving liquid. For example, in the moving direction of the transfer body 101 facing the ink applying device 104, an ink jet head for the clear ink for improving transferability is provided at the downstream side of the ink jet heads for color inks. After application of color inks onto the transfer body 101, the clear ink is applied to the transfer body with the color inks, and consequently the clear ink is present on the outermost face of an ink image. When the ink image is transferred to a recording medium by the transfer unit, the clear ink on the surface of the ink image adheres to the recording medium 108 at a certain adhesive power, and this facilitates the transfer of the ink image after liquid removal to the recording medium 108.

<Ink>

Components constituting the ink applicable in the present embodiment will next be described in detail.

(Coloring Material)

As the coloring material, a pigment or a dye can be used. In the ink, the content of the coloring material is preferably 0.5% by mass or more to 15.0% by mass or less and more preferably 1.0% by mass or more to 10.0% by mass or less relative to the total mass of the ink.

Specific examples of the pigment include inorganic pigments such as carbon black and titanium oxide; and organic pigments such as azo pigments, phthalocyanine pigments, quinacridone pigments, isoindolinone pigments, imidazolone pigments, diketopyrrolopyrrole pigments and dioxazine pigments.

In terms of the dispersion manner of a pigment, a resin-dispersed pigment containing a resin as the dispersant or a self-dispersible pigment in which the particle surface of a pigment is bonded to a hydrophilic group can be used. In addition, a resin-bonded pigment in which the particle surface of a pigment is chemically bonded to an organic group containing a resin or a microcapsule pigment in which the particle surface of a pigment is covered with a resin or the like can also be used, for example.

As the resin dispersant for dispersing a pigment in an aqueous medium, a dispersant having an anionic group that enables a pigment to be dispersed in an aqueous medium is preferably used. As the resin dispersant, such resins as described later can be preferably used, and water-soluble resins can be more preferably used. The mass ratio of the content (% by mass) of the pigment to the content of the resin dispersant (pigment/resin dispersant) is preferably 0.3 times or more to 10.0 times or less.

As the self-dispersible pigment, a pigment in which an anionic group such as a carboxylic acid group, a sulfonic acid group and a phosphonic acid group is bonded directly or through an additional atomic group (—R—) to the particle surface of the pigment can be used. The anionic group may be either an acid form or a salt form. An anionic group in a salt form may be dissociated partly or completely. Examples of the cation as the counter ion of an anionic group in a salt form include alkali metal cations; ammonium; and organic ammoniums. Specific example of the additional atomic group (—R—) include linear or branched alkylene groups having 1 to 12 carbon atoms; arylene groups such as a phenylene group and a naphthylene group; a carbonyl group; an imino group; an amido group; a sulphonyl group; an ester group; and an ether group. The additional atomic group may be a combination group of them.

As the dye, a dye having an anionic group is preferably used. Specific examples of the dye include azo dyes, triphenylmethane dyes, (aza)phthalocyanine dyes, xanthene dyes and anthrapyridone dyes.

(Resin)

The ink contains a resin having a softening point. In the ink, the content (% by mass) of the resin is preferably 0.1% by mass or more to 20.0% by mass or less and more preferably 0.5% by mass or more to 15.0% by mass or less relative to the total mass of the ink.

The resin can be added (i) for stabilizing the dispersion state of a pigment, or as the above-mentioned resin dispersant or an assistant therefor, and (ii) for improving various properties of an image to be recorded, for example. Examples of the resin, in terms of structure, include a block copolymer, a random copolymer, a graft copolymer and combinations of them. The resin may be in a dissolved state as a water-soluble resin in an aqueous medium or in a dispersed state as resin particles in an aqueous medium. The resin particles do not necessarily contain a coloring material.

In the present invention, the water-soluble resin is a resin that does not form particles having such a particle diameter as to be determined by dynamic light scattering when the resin is neutralized with an equivalent amount of an alkali to the acid value thereof. Whether the resin is water-soluble can be determined by the following procedure. First, a resin is neutralized with an alkali (for example, sodium hydroxide or potassium hydroxide) in an amount corresponding to the acid value thereof to give a liquid containing the resin (resin solid content: 10% by mass). Next, the prepared liquid is diluted 10-fold (in terms of volume) with pure water to give a sample solution. The resin particle diameter in the sample solution is then measured by dynamic light scattering. When particles having particle diameters are not observed, such a resin can be determined to be water-soluble. The conditions for the measurement can be set as follows, for example: SetZero: 30 seconds; number of measurement times: 3; and measurement time: 180 seconds. As the particle size distribution analyzer, a particle size analyzer by dynamic light scattering (for example, trade name "UPA-EX150", manufactured by NIKKISO CO., LTD.) can be used, for example. Needless to say, the particle size distribution analyzer, the measurement conditions and the like are not limited to the above.

As for the acid value of a resin, the water-soluble resin preferably has an acid value of 100 mg KOH/g or more to 250 mg KOH/g or less, and the resin particles preferably have an acid value of 5 mg KOH/g or more to 100 mg KOH/g or less. As for the weight-average molecular weight of a resin, the water-soluble resin preferably has a weight-average molecular weight of 3,000 or more to 15,000 or less, and the resin particles preferably have a weight-average molecular weight of 1,000 or more to 2,000,000 or less. The resin particles preferably have a volume-average particle diameter of 100 nm or more to 500 nm or less that is determined by dynamic light scattering (the measurement conditions are the same as above).

Examples of the resin include acrylic resins, urethane resins and olefinic resins. Of them, acrylic resins and urethane resins are preferred.

The acrylic resin preferably has a hydrophilic unit and a hydrophobic unit as constitutional units. Specifically preferred is a resin having a hydrophilic unit derived from (meth)acrylic acid and a hydrophobic unit derived from at least one of a monomer having an aromatic ring and a (meth)acrylate monomer. Particularly preferred is a resin having a hydrophilic unit derived from (meth)acrylic acid and a hydrophobic unit derived from at least one monomer of styrene and α-methylstyrene. These resins are likely to interact with a pigment and thus can be preferably used as a resin dispersant for dispersing a pigment.

The hydrophilic unit is a unit having a hydrophilic group such as an anionic group. The hydrophilic unit can be formed by polymerizing a hydrophilic monomer having a hydrophilic group, for example. Specific examples of the hydrophilic monomer having a hydrophilic group include acidic monomers having a carboxylic acid group, such as (meth)acrylic acid, itaconic acid, maleic acid and fumaric acid and anionic monomers such as anhydrides and salts of these acidic monomers. Examples of the cation constituting a salt of an acidic monomer include a lithium ion, a sodium ion, a potassium ion, an ammonium ion and organic ammonium ions. The hydrophobic unit is a unit not having a hydrophilic group such as an anionic group. The hydrophobic unit can be formed by polymerizing a hydrophobic monomer not having a hydrophilic group such as an anionic group, for example. Specific examples of the hydrophobic monomer include monomers having an aromatic ring, such as styrene, α-methylstyrene and benzyl (meth)acrylate; and (meth)acrylate monomers such as methyl (meth)acrylate, butyl (meth)acrylate and 2-ethylhexyl (meth)acrylate.

The urethane resin can be prepared by reacting a polyisocyanate with a polyol, for example. The urethane resin can be prepared by further reacting a chain extender. Examples of the olefinic resin include polyethylene and polypropylene.

(Aqueous Medium)

The ink can contain water or an aqueous medium as a mixed solvent of water and a water-soluble organic solvent. As the water, deionized water or ion-exchanged water is preferably used. In the aqueous ink, the content (% by mass) of water is preferably 50.0% by mass or more to 95.0% by mass or less relative to the total mass of the ink. In the aqueous ink, the content (% by mass) of the water-soluble organic solvent is preferably 3.0% by mass or more to 50.0% by mass or less relative to the total mass of the ink. As the water-soluble organic solvent, any solvent usable in ink jet inks, such as alcohols, (poly)alkylene glycols, glycol ethers, nitrogen-containing compounds and sulfur-containing compounds, can be used.

(Additional Additive)

The ink can contain, in addition to the above components, various additives such as an antifoaming agent, a surfactant, a pH adjuster, a viscosity modifier, an anticorrosive, an antiseptic agent, an antifungal agent, an antioxidant and a reduction inhibitor, as needed.

<Liquid Absorbing Device>

Figure 2:
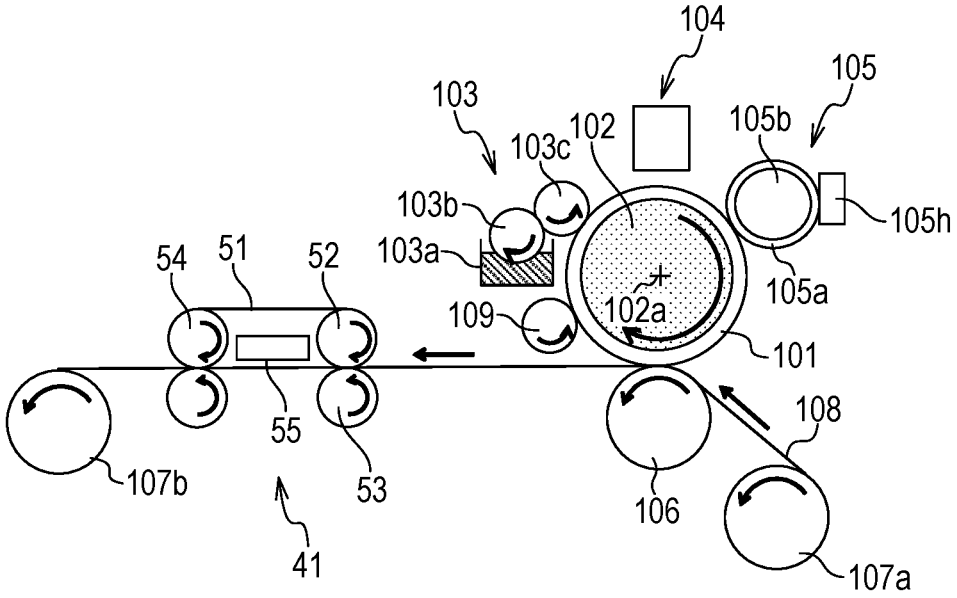
FIG. 2 is a schematic view showing an exemplary structure of a transfer type ink jet recording apparatus according to an embodiment of the present invention.

In the present embodiment, the liquid absorbing device 105 includes a liquid absorbing member 105*a* and a pressing member for liquid absorption 105*b* for pressing the liquid absorbing member 105*a* against an ink image on the transfer body 101. The liquid absorbing member 105*a* and the pressing member 105*b* may have any shape. Such a configuration as shown in FIG. 1 is exemplified. In the configuration, the pressing member 105*b* has a column shape, the liquid absorbing member 105*a* has a belt shape, and the column-shaped pressing member 105*b* presses the belt-shaped liquid absorbing member 105*a* against the transfer body 101. In another exemplary configuration as shown in FIG. 2, the pressing member 105*b* has a column shape, the liquid absorbing member 105*a* has a hollow column shape formed on the peripheral surface of the column-shaped pressing member 105*b*, and the column-shaped pressing member 105*b* presses the hollow column-shaped liquid absorbing member 105*a* against the transfer body. In this case, preferred is a configuration including a liquid collecting member 105*h* that comes into contact with the outer face of the liquid absorbing member 105*a* to collect the liquid removed from an image. The liquid absorbing member 105*a* that has absorbed the liquid from an image rotates in the circumferential direction (clockwise direction or counterclockwise direction) and moves to a position at which the liquid collecting member 105*h* can collect the liquid absorbed in the liquid absorbing member 105*a*. The liquid collecting member 105*h* is not necessarily in contact with the outer face of the liquid absorbing member 105*a*, but such a configuration that a liquid collecting member is in contact with the back face and also serves as the pressing member 105*b* is also preferred.

In the present embodiment, the liquid absorbing member 105*a* preferably has a belt shape in consideration of the space in the ink jet recording apparatus, for example.

The liquid absorbing device 105 including such a belt-shaped liquid absorbing member 105*a* may also include extending members for extending the liquid absorbing member 105*a*. In FIGS. 1, 105*c*, 105*d* and 105*e* are extending rollers as the extending members. In FIG. 1, the pressing member 105*b* is also a roller member rotating as with the extending rollers, but is not limited to this.

In the liquid absorbing device 105, the pressing member 105*b* allows the liquid absorbing member 105*a* including a porous body to come into contact with and to press against an ink image, thus the liquid absorbing member 105*a* absorbs a liquid component contained in the ink image, and the liquid component is reduced. After the present system of bringing the liquid absorbing member into contact, various conventional techniques, such as a heating method, a method of blowing air with low humidity, and a decompression method, may be performed as a method of further reducing the liquid component in the ink image. In particular, a heating step of heating an ink image after the liquid removing step is preferably included. When a liquid component is removed from an ink image by the liquid removing step before the heating step, an ink image before contact with the porous body of the liquid absorbing member contains a larger amount of the liquid component than the case in which the heating step is performed and then the liquid component is removed from the ink image by the liquid removing step. Hence, solid components in the ink image are likely to aggregate by the contact of the porous body, and the ratio of voids among the solid contents (for example, resins) in the ink image after the liquid removing step is easily reduced. Accordingly, the void ratio in a final image (ink image) after the smoothing step (fixation step) is reduced, and thus the deterioration of glossiness can be further suppressed even when time passes after the formation of a final image on a recording medium. In the heating step, the ink image after the liquid removing step is preferably heated by warm air or infrared light.

<Liquid Absorbing Member>

In the present embodiment, by bringing the liquid absorbing member 105*a* having a porous body into contact with an ink image before liquid removal, at least some of the liquid component is absorbed and removed from the image, and thus the content of the liquid component in the ink image is reduced. The contact face of the liquid absorbing member with an ink image is regarded as a first face, and the porous body is placed on the first face. Such a liquid absorbing member including a porous body preferably has such a configuration that the liquid absorbing member moves as the liquid receiving medium moves, then comes into contact with an ink image, and further rotates at a certain cycle to come into contact with another ink image before liquid removal, enabling liquid absorption. Examples of the shape include an endless-belt shape and a drum shape.

(Porous Body)

The porous body of the liquid absorbing member pertaining to the present embodiment preferably has a smaller average pore diameter on the first face than the average pore diameter on a second face that is opposite to the first face. In order to suppress the adhesion of a coloring material in an ink to the porous body, the pore diameter is preferably small, and at least the porous body on the first face that comes into contact with an image preferably has an average pore diameter of 10 μm or less. In the present embodiment, the average pore diameter means an average diameter on the surface of the first face or the second face, and can be determined by a known technique such as a mercury intrusion method, a nitrogen adsorption method and SEM image observation.

The porous body preferably has a small thickness in order to evenly achieve high breathability. The breathability can be expressed as a Gurley value in accordance with JIS P8117, and the Gurley value is preferably 10 seconds or less.

A thin porous body, however, may not ensure a capacity sufficient to absorb a liquid component, and thus the porous body can have a multilayer structure. In the liquid absorbing member, only the layer to come into contact with an ink image is required to be a porous body, and a layer not to come into contact with an ink image is not necessarily a porous body.

Next, an embodiment of the porous body having a multilayer structure will be described. In this explanation, the layer to come into contact with an ink image is a first layer, and the layer laminated on the face opposite to the contact face of the first layer with the ink image is a second layer. For a structure including three or more layers, the layers are expressed in the laminating order successively from the first layer. In the present specification, the first layer is also called an "absorbing layer", and the second and subsequent layers are also called "support layers".

In the present embodiment, the first layer may be made of any material. Any of hydrophilic materials having a contact angle with water of less than 90° and water-repellent materials having a contact angle of 90° or more can be used.

The hydrophilic material is preferably selected from raw materials such as cellulose and polyacrylamide, and composite materials of them, for example. The surface of the water-repellent materials mentioned below can be subjected to hydrophilization treatment, and a resulting material can be used as the hydrophilic material. The hydrophilization treatment is performed by a method such as sputter etching, radiation exposure, $H_2O$ ion exposure and excimer (ultraviolet) laser beam irradiation.

When used, the hydrophilic material preferably has a contact angle with water of 60° or less. The hydrophilic material has the function of sucking a liquid, especially water, by capillary force.

In order to suppress the adhesion of a coloring material and to improve cleanability, the material of the first layer is preferably a water-repellent material having a low surface free energy, specifically a fluororesin. Specific examples of the fluororesin include polytetrafluoroethylene (PTFE), polychlorotrifluoroethylene (PCTFE), polyvinylidene fluoride (PVDF), polyvinyl fluoride (PVF), perfluoroalkoxy fluororesin (PFA), a tetrafluoroethylene/hexafluoropropylene copolymer (FEP), an ethylene/tetrafluoroethylene copolymer (ETFE) and an ethylene/chlorotrifluoroethylene copolymer (ECTFE). These resins can be used singly or in combination of two or more of them, as needed. The first layer may include a plurality of laminated films. A water-repellent material has almost no function of sucking liquid by capillary force, and may take time to suck liquid when coming into contact with an image for the first time. On this account, the first layer is preferably impregnated with a liquid having a contact angle with the first layer of less than 90°. The liquid can be applied onto the first face of the liquid absorbing member to be infiltrated into the first layer. The liquid is preferably prepared by mixing water with a surfactant or a liquid having a low contact angle with the first layer.

In the present embodiment, the first layer preferably has a film thickness of 50 μm or less. The film thickness is more preferably 30 μm or less. In examples of the embodiment, the film thickness was determined as follows: a linear micrometer, OMV-25 (manufactured by Mitutoyo) was used to measure film thicknesses at any 10 points; and the average was calculated. As for the smoothness, the first layer preferably has an arithmetic average height Sa of 1 μm or less from the viewpoint of image smoothing by the fixing device described later. The smoothness was determined as follows: a white-light interferometer (VertScan (registered trademark), manufactured by Ryoka Systems) was used to measure Sa at any 10 points; and the average was calculated.

The first layer can be produced by a known method for producing a thin porous film. For example, a resin material can be subjected to extrusion molding or a similar technique to give a sheet-shaped material, and the sheet-shaped material can be drawn into an intended thickness, yielding a first layer. Alternatively, a plasticizer such as paraffin can be added to the material for extrusion molding, and the plasticizer can be removed, for example, by heating at the time of drawing, yielding a porous film. The pore diameter can be adjusted by appropriately controlling the amount of a plasticizer or the draw ratio, for example.

[Second Layer]

In the present embodiment, the second layer is preferably a layer having breathability. Such a layer can be either a nonwoven fabric or a woven fabric of resin fibers. The second layer may be made of any material. In order to prevent a liquid absorbed by the first layer from flowing back, the contact angle of the material with the first liquid is preferably equal to or lower than that of the first layer. Specifically, the material is preferably selected from raw materials such as polyolefins (including polyethylene (PE) and polypropylene (PP)), polyurethanes, polyamides such as nylon, polyesters (including polyethylene terephthalate (PET)) and polysulfone (PSF) and composite materials of them, for example. The second layer is preferably a layer having a larger pore diameter than that of the first layer.

[Third Layer]

In the present embodiment, the porous body having a multilayer structure may include three or more layers and is not limited. The third and subsequent layers are preferably a nonwoven fabric from the viewpoint of rigidity. As the material, a similar material to that for the second layer can be used.

[Additional Materials]

The liquid absorbing member may include, in addition to the above porous body having a multilayer structure, a reinforcing member that reinforces side faces of the liquid absorbing member. The liquid absorbing member may also include a joining member that joins the longitudinal ends of a long sheet-shaped porous body to form a belt-shaped member. For example, a non-porous tape material can be used as such a material and can be placed at a position or a cycle with which images do not come into contact.

[Production Method of Porous Body]

The method of laminating the first layer and the second layer to form the porous body may be any method. The layers can be simply laminated or can be bonded to each other by a technique such as lamination with an adhesive agent or thermal lamination. From the viewpoint of breathability, thermal lamination is preferred in the present embodiment. Alternatively, the first layer or the second layer may be partly melted by heat, and the layers may be adhesively laminated, for example. A fusing material such as a hot melt powder may be interposed between the first layer and the second layer, and the layers may be adhesively laminated by heating. When a third or subsequent layer is laminated, layers may be laminated at once, or may be laminated successively.

In the heating process, preferred is a lamination method in which porous bodies are heated while the porous bodies are interposed between heated rollers and pressed.

Various conditions and components of the liquid absorbing device 105 will next be described in detail.

(Pretreatment)

In the present embodiment, before the liquid absorbing member 105*a* including the porous body is brought into contact with an ink image, the liquid absorbing member is preferably subjected to pretreatment with a pretreatment means (not shown in FIGS. 1 to 3) that applies a treatment liquid to the liquid absorbing member. The treatment liquid used in the present embodiment preferably contains water and a water-soluble organic solvent. The water is preferably a deionized water prepared by ion exchanging, for example. The water-soluble organic solvent is not limited to particular types, and any known organic solvent such as ethanol and isopropyl alcohol can be used. In the pretreatment of the liquid absorbing member used in the present embodiment, the application method may be any method, but immersing or liquid dropping is preferred.

(Pressing Conditions)

When the porous body included in the liquid absorbing member is brought into contact with an ink image on the transfer body under pressure, the pressure of the liquid absorbing member is preferably 2.9 N/cm$^2$ (0.3 kgf/cm$^2$) or more to 98.1 N/cm$^2$ (10 kgf/cm$^2$) or less. When the pressure is within the range, the liquid component in an ink image can be separated from solids for a short period of time, thus the liquid component can be removed from the ink image, and the ink image can be prevented from adhering to the liquid absorbing member. From the viewpoint of suppressing gloss changes, the pressure of the liquid absorbing member is more preferably 14.7 N/cm$^2$ (1.5 kgf/cm$^2$) or more to 98.1 N/cm$^2$ (10 kgf/cm$^2$) or less and even more preferably 49.0 N/cm$^2$ (5 kgf/cm$^2$) or more to 98.1 N/cm$^2$ (10 kgf/cm$^2$) or less. The pressure of a liquid absorbing member in the present specification represents the nip pressure between a liquid receiving medium and a liquid absorbing member, and is the value determined by the following procedure: a surface pressure distribution measuring device ("I-SCAN" manufactured by Nitta) is used to perform surface pressure measurement; and the load in a pressed region is divided by the area to give the pressure.

(Application Time)

The application time for contact of the liquid absorbing member 105*a* with an ink image is preferably within 50 ms in order to further suppress the adhesion of a coloring material in the ink image to the liquid absorbing member. In the present specification, the application time is calculated by dividing a pressure detection width in a movement direction of the liquid receiving medium in the above surface pressure measurement by the movement speed of the liquid receiving medium. Hereinafter, the application time is called a liquid absorbing nip time.

In this manner, an ink image from which the liquid component is absorbed to reduce the liquid component is formed on the transfer body 101. In the liquid removing step, the liquid absorbing member is brought into contact with an ink image without pressure or under pressure to remove the liquid component contained in the ink image, and thus solid contents come close to each other. Accordingly, voids are unlikely to be generated after the smoothing step by the fixing device described later, and a gloss change is suppressed. In order to effectively suppress gloss changes, it is important that the removal rate of the liquid component be 70% by mass or more. The removal rate of the liquid component is preferably 80% by mass or more. The upper limit of the removal rate of the liquid component is 100% by mass.

In the present specification, the removal rate of a liquid component is calculated from the ratio of an applied liquid amount in an ink image formed on the transfer body 101 in the ink application step and a removed liquid amount after the liquid removing step. The applied liquid amount is an amount calculated from the concentration of the liquid component contained in an ink and the amount of the ink applied to the transfer body 101. The removed liquid amount is an amount calculated by subtracting the weight of an ink image after the liquid removing step from the applied liquid amount. The amount of the liquid component in the ink image just before the liquid removing step is preferably 0.5 g/m$^2$ or more to 30.0 g/m$^2$ or less. The amount of the liquid component in the ink image just after the liquid removing step is preferably 0.2 g/m$^2$ or more to 9.0 g/m$^2$ or less. The amount of the liquid component in the ink image just before the transfer step is preferably 0.2 g/m$^2$ or more to 9.0 g/m$^2$ or less.

When the contained liquid component is removed from an ink image under pressure in the liquid removing step, the ink image is compressed to change the thickness of the ink image. In the present invention, the liquid absorbing member is brought into contact with an ink image, and thus the above-mentioned liquid removal rate strongly relates to the rate of change in thickness of an ink image before and after the liquid removing step. The rate of change in thickness of an ink image before and after the liquid removing step is preferably 70% or more, more preferably 80% or more and even more preferably 90% or more. The thickness of an ink image before the liquid removing step is calculated from a value measured with a density and specific gravity meter (DA-605, manufactured by Kyoto Electronics Manufacturing). The thickness of an ink image after the liquid removing step is determined by using a white-light interferometer (VertS can (registered trademark), manufactured by Ryoka Systems) as the difference from an area with no ink image.

The ink image after liquid removal is transferred onto a recording medium 108 by the subsequent transfer unit. The device configuration and conditions for transfer will be described.

<Pressing Member for Transfer>

In the present embodiment, the ink image after liquid removal on the transfer body 101 is brought into contact with a recording medium 108 conveyed by a recording medium conveyance means 107, by a pressing member for transfer 106 included in a transfer device and is thereby transferred onto the recording medium 108. The liquid component contained in the ink image on the transfer body 101 is removed, then the image is transferred onto the recording medium 108, and consequently a recorded image prevented from causing curing, cockling or the like can be produced.

The pressing member 106 is required to have a certain structural strength from the viewpoint of the conveyance accuracy of a recording medium 108 or durability. As the material of the pressing member 106, metals, ceramics, resins and the like are preferably used. Specifically, aluminum, iron, stainless steel, acetal resins, epoxy resins, polyimide, polyethylene, polyethylene terephthalate, nylon, polyurethane, silica ceramics and alumina ceramics are preferably used in terms of the rigidity capable of withstanding the pressure at the time of transfer, dimensional accuracy and reduction of the inertia during operation to improve the control responsivity. These materials may be used in combination.

The pressing time of the pressing member 106 that presses against the transfer body for transferring an ink image after liquid removal on the transfer body 101 to a recording medium 108 is not limited to particular values. The pressing time is preferably 5 ms or more to 100 ms or less in order to achieve satisfactory transfer and not to deteriorate the durability of the transfer body. The pressing time in the embodiment represents the time during the contact of a recording medium 108 with a transfer body 101 and is the value determined by the following procedure: a surface pressure distribution measuring device ("I-SCAN" manufactured by Nitta) is used to perform surface pressure measurement; and the length of a pressed region in the conveyance direction is divided by the conveyance speed to give the pressing time.

The pressure of the pressing member 106 against the transfer body 101 for transferring an ink image after liquid removal on the transfer body 101 to a recording medium 108 is not limited to particular values, but is so controlled as to achieve satisfactory transfer and not to deteriorate the durability of the transfer body. Hence, the pressure is preferably 9.8 $N/cm^2$ (1 $kg/cm^2$) or more to 294.2 $N/cm^2$ (30 $kg/cm^2$) or less. The pressure in the embodiment represents the nip pressure between a recording medium 108 and a transfer body 101, and is a value determined by the following procedure: a surface pressure distribution measuring device is used to perform surface pressure measurement; and the load in a pressed region is divided by the area to give the pressure.

The temperature when the pressing member 106 presses against the transfer body 101 for transferring an ink image after liquid removal on the transfer body 101 to a recording medium 108 is also not limited to particular values, but is preferably a temperature not less than the glass transition point of the resin component contained in an ink or a temperature not less than the softening point. A preferred embodiment for heating includes a heating means for heating a second image on the transfer body 101, the transfer body 101 and a recording medium 108.

The shape of the pressing member 106 is not limited to particular shapes, but a roller shape is exemplified.

<Recording Medium and Recording Medium Conveyance Device>

In the present embodiment, the recording medium 108 is not limited to particular media, and any known recording medium can be used. Examples of the recording medium include long media rolled into a roll and sheet media cut into a certain size. Examples of the material include paper, plastic films, wooden boards, cardboard and metal films.

In FIG. 1, the recording medium conveyance device 107 for conveying the recording medium 108 includes a recording medium delivery roller 107*a* and a recording medium winding roller 107*b*, but may include any members capable of conveying a recording medium, and is not specifically limited to the structure.

<Fixing Device (Smoothing Device)>

In the present invention, a fixing device (fixing unit) 41 for improving the surface smoothness of an image transferred onto a recording medium is included. The fixing device 41 is used to improve the surface smoothness of an image transferred onto a recording medium, thereby giving such a highly glossy image as silver halide photographs.

In the present invention, the fixing device 41 includes a fixing belt 51 as a fixing member, a heat roller (heating unit) 52, a support roller 53, a release roller 54 and a cooler 55. The release roller 54 and the cooler 55 are called a cooling and releasing unit. The fixing belt 51 is extended between the heat roller 52 and the release roller 54 and rotates synchronously with the conveyance device 107. The heat roller 52 and the support roller 53 are placed while the fixing belt 51 is interposed therebetween, and heat and press the fixing belt 51 and the recording medium 108 to allow the fixing belt 51 to come into close contact with an image formed on the recording medium 108.

To allow the fixing belt 51 to come into close contact with an image on the recording medium 108, a temperature and a pressure sufficient for softening solid components (more specifically, solid components having a softening point, such as resin particles) contained in the ink included in the image by heat and for close contact with the fixing belt 51 are applied. The heat roller 52 may have a system in which a heat source such as a halogen heater is provided in the roller and heats the fixing belt 51 to a predetermined temperature. Alternatively, a system in which a heat source such as an IR heater is provided outside a roller and heats the fixing belt 51 to a predetermined temperature may be employed. Alternatively, heat sources may be provided inside and outside a roller. Specifically, the predetermined temperature is a temperature not less than the softening point of the above solid components and is a temperature at which an ink image is softened. For example, the surface temperature of the fixing belt (fixing member) immediately before contact with a recording medium is preferably 100° C. or more to 280° C. or less.

The cooler 55 is provided between the heat roller 52 and the release roller 54 and is for cooling the fixing belt 51 and the recording medium 108 to a temperature at which an ink is solidified and the fixing belt 51 can be completely released from the recording medium 108. Specifically, the temperature is a temperature less than the softening point of the resin and is a temperature at which an ink image solidifies. For example, the surface temperature of the fixing belt (fixing member) immediately after the release of the recording medium is preferably 30° C. or more to 65° C. or less. The cooler 55 is not limited to particular devices and can be selected from a noncontact cooling system by sending cool air, a contact cooling system by application of cold water and similar systems in consideration of device sizes or energy consumption. The release roller 54 is provided at the most downstream side in the fixing device and is to release the fixing belt 51 from the recording medium 108 while the ink included in an image is solidified. Through such a process, an image on the recording medium 108 can reproduce the smooth surface shape on the outer peripheral face of the fixing belt 51.

The thickness of an image after release of the recording medium 108 from the fixing belt 51 is preferably 90% or more of the image thickness before fixation (smoothing). If the rate of change in thickness before and after the smoothing step is more than 10%, the ink layer is insufficiently compressed in the liquid removing step, and the glossiness value changes as time passes after fixation.

The member of the outer peripheral face on the fixing belt 51 is preferably a member having substantially the same smoothness as that of silver halide photographs and having a high surface free energy for allowing an image on the recording medium 108 to come into close contact for a short period of time. For example, a polyimide substrate such as Kapton (registered trademark, manufactured by DU PONT- TORAY Co., Ltd.) is preferred. Substantially the same smoothness as that of silver halide photographs can be determined with an image clarity meter (manufactured by Suga Test Instruments, ICM-1T). When the image clarity C (2) (%) is 50 or more to 100 or less at an optical comb width of 2 mm, such a sample is determined to have substantially the same smoothness as that of silver halide photographs. Further, the arithmetic average roughness Ra of the surface of the fixing belt (fixing member) which is the side contacting with the ink image is preferably 0.01 μm or more to 0.15 μm or less.

<Control System>

Figure 6:
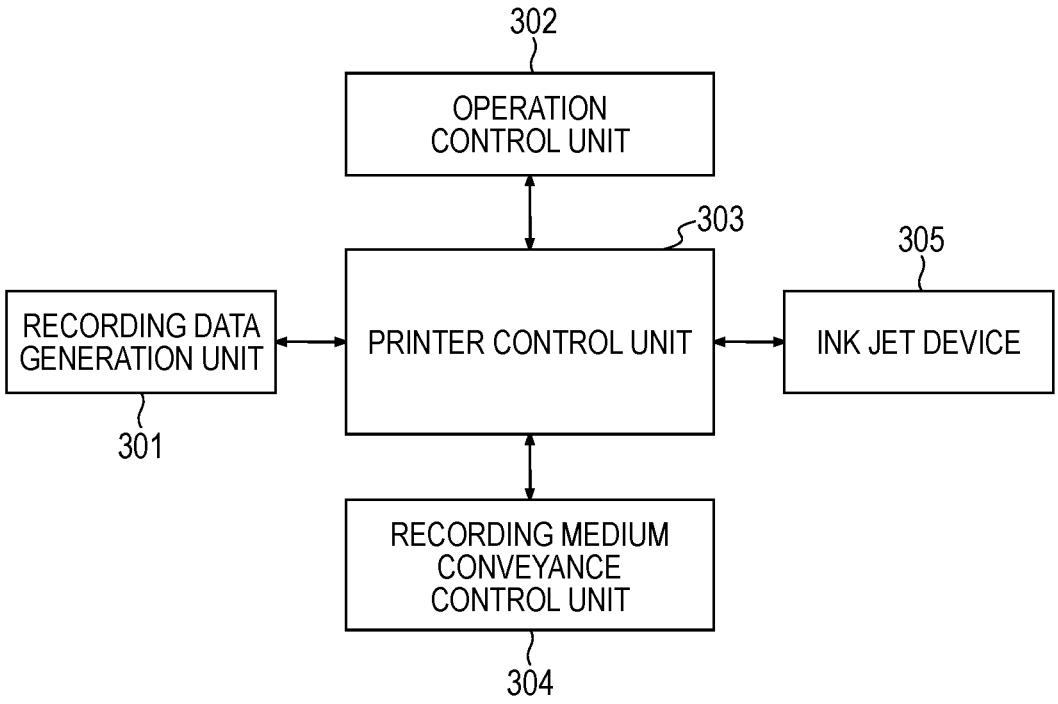
FIG. 6 is a block diagram showing a control system for the whole ink jet recording apparatuses shown in FIGS. 1 to 5.

The transfer type ink jet recording apparatus in the embodiment has a control system for controlling each device. FIG. 6 is a block diagram of a control system for the whole transfer type ink jet recording apparatuses shown in FIGS. 1 to 4.

In FIG. 6, a recording data generation unit 301 generates recording data and is, for example, an external print serve. An operation control unit 302 is such a unit as an operation panel and controls operation. A printer control unit 303 executes a recording process. A recording medium conveyance control unit 304 conveys a recording medium. An ink jet device 305 is a device for printing.

Figure 7:
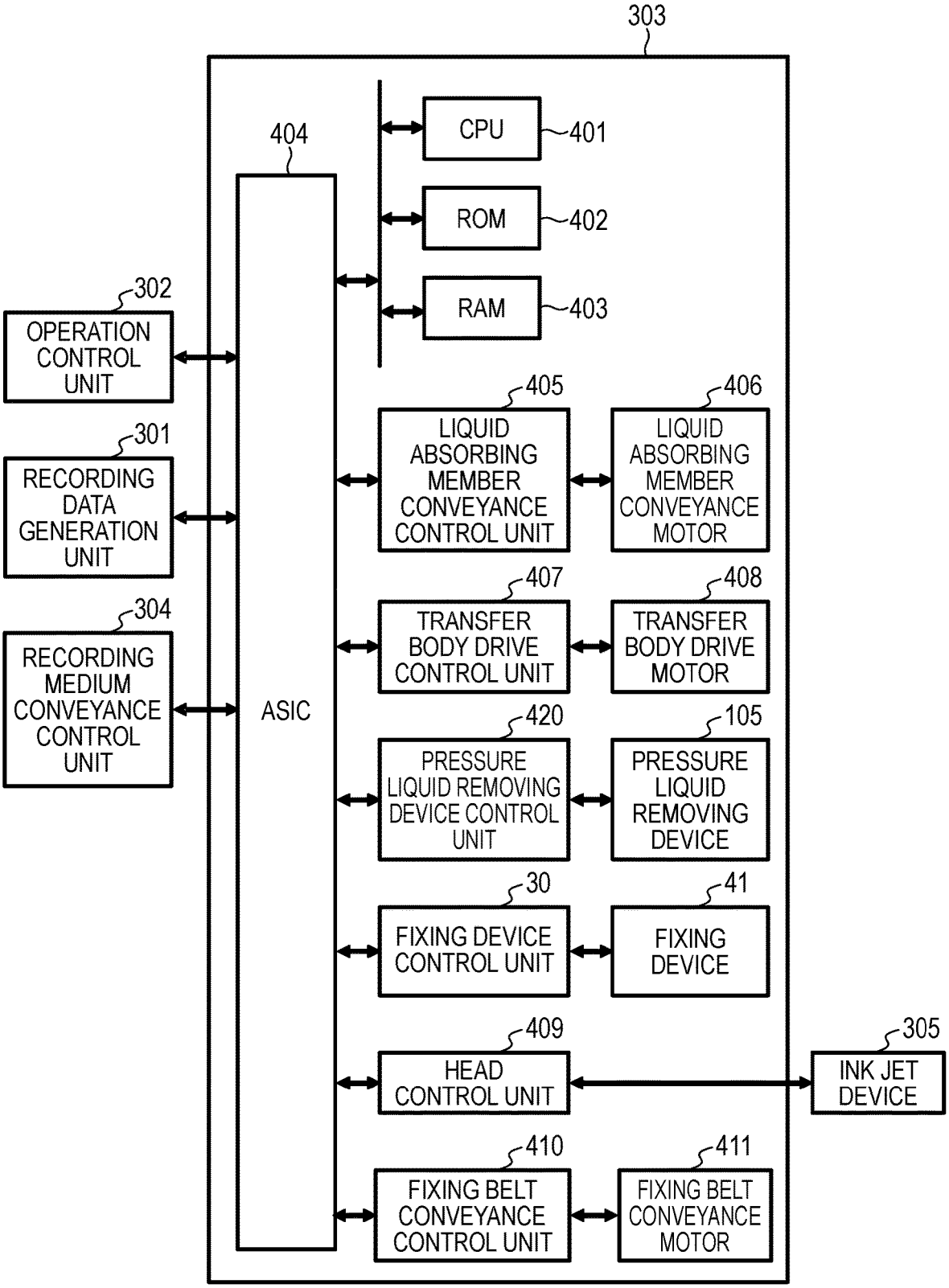
FIG. 7 is a block diagram of a printer control unit in the transfer type ink jet recording apparatuses shown in FIGS. 1 to 4.

FIG. 7 is a block diagram of the printer control unit in the transfer type ink jet recording apparatuses shown in FIGS. 1 to 4.

401 is a CPU for controlling the whole printer, 402 is a ROM for storing a control program of the CPU 401, and 403 is a RAM for executing a program. 404 is an application specific integrated circuit (ASIC) including a network controller, a serial IF controller, a controller for generating head data, a motor controller and the like. 405 is a liquid absorbing member conveyance control unit for driving a liquid absorbing member conveyance motor 406 and is controlled by a command from the ASIC 404 via a serial IF. 407 is a transfer body drive control unit for driving a transfer body drive motor 408 and is also controlled by a command from the ASIC 404 via a serial IF. 409 is a head control unit and performs final ejection data generation for the ink jet device 305 and drive voltage generation, for example. 410 is a fixing belt conveyance control unit for driving a fixing belt conveyance motor 411 and is controlled by a command from the ASIC 404 via a serial IF. A liquid removing device control unit 420 controls the pressure or the like in the liquid removing device (liquid absorbing device) 105. A fixing device control unit 30 controls the temperature, the pressure and the like of the fixing device 41.

(Direct Drawing Type Ink Jet Recording Apparatus)

As another embodiment in the embodiment, a direct drawing type ink jet recording apparatus is exemplified. In the direct drawing type ink jet recording apparatus, the liquid receiving medium is a recording medium on which an image is to be formed.

Figure 5:
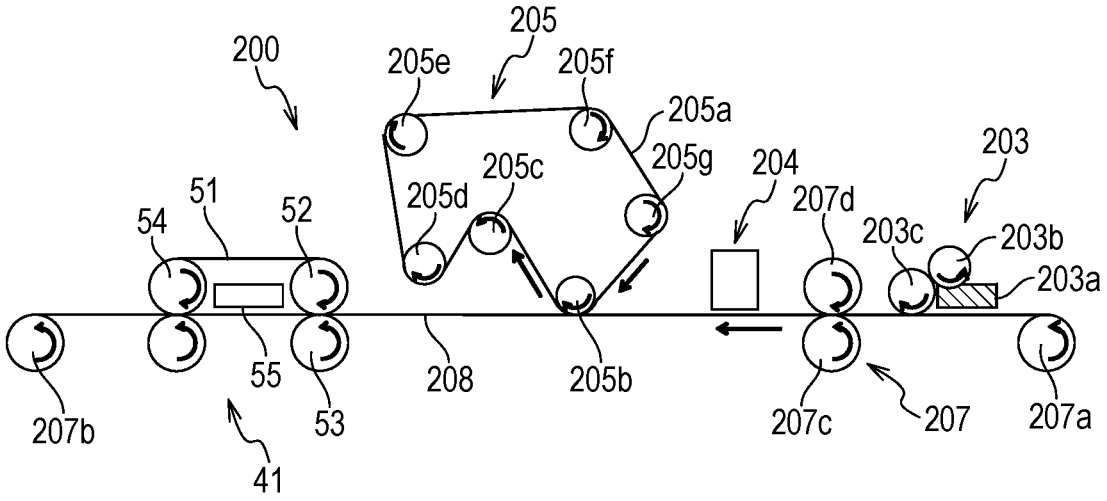
FIG. 5 is a schematic view showing an exemplary structure of a direct drawing type ink jet recording apparatus according to an embodiment of the present invention.

FIG. 5 is a schematic view showing an exemplary schematic structure of a direct drawing type ink jet recording apparatus 200 in the present embodiment. As compared with the above transfer type ink jet recording apparatus, the direct drawing type ink jet recording apparatus includes no transfer body 101, no support member 102 or no transfer body cleaning member 109 and forms an image directly on a recording medium 208. Except the above, the direct drawing type ink jet recording apparatus includes substantially the same means as in the transfer type ink jet recording apparatus.

Hence, a reaction liquid applying device (reaction liquid applying unit) 203, an ink applying device (ink image forming unit) 204, a liquid absorbing device 205 and a fixing device 41 have substantially the same structure as in the transfer type ink jet recording apparatus and are not specifically described.

In the direct drawing type ink jet recording apparatus of the embodiment, the liquid absorbing device 205 includes a liquid absorbing member 205*a* and a pressing member for liquid absorption 205*b* that presses the liquid absorbing member 205*a* against an ink image on a recording medium 208. The liquid absorbing member 205*a* and the pressing member 205*b* may have any shape, and members having substantially the same shapes as those of the liquid absorbing member and the pressing member usable in the transfer type ink jet recording apparatus can be used. The liquid absorbing device 205 may further include extending members for extending the liquid absorbing member. In FIG. 5, 205*c*, 205*d*, 205*e*, 205*f* and 205*g* are extending rollers as the extending members. The number of extending rollers is not limited to five as shown in FIG. 5, and an intended number of rollers can be arranged depending on an apparatus design. An ink applying unit including the ink applying device 204 that applies an ink to the recording medium 208 may further include a recording medium support member, not shown in the drawings, for supporting the recording medium from below. A liquid component removing unit including the liquid absorbing member 205*a* that comes into contact with an ink image on the recording medium to remove a liquid component may also further include a recording medium support member not shown in the drawings. An ink is so applied to a recording medium as to at least partly overlap with a region where a reaction liquid is applied.

<Recording Medium Conveyance Device>

In the direct drawing type ink jet recording apparatus of the embodiment, a recording medium conveyance device 207 is not limited to particular devices, and a conveyance means in a known direct drawing type ink jet recording apparatus can be used. As shown in FIG. 5, a recording medium conveyance device including a recording medium delivery roller 207*a*, a recording medium winding roller 207*b* and recording medium conveyor rollers 207*c*, 207*d* is exemplified.

<Control System>

The direct drawing type ink jet recording apparatus in the embodiment has a control system for controlling each device. A block diagram of the control system for the whole direct drawing type ink jet recording apparatus shown in FIG. 5 is as shown in FIG. 6 as with the transfer type ink jet recording apparatus shown in FIG. 1.

Figure 8:
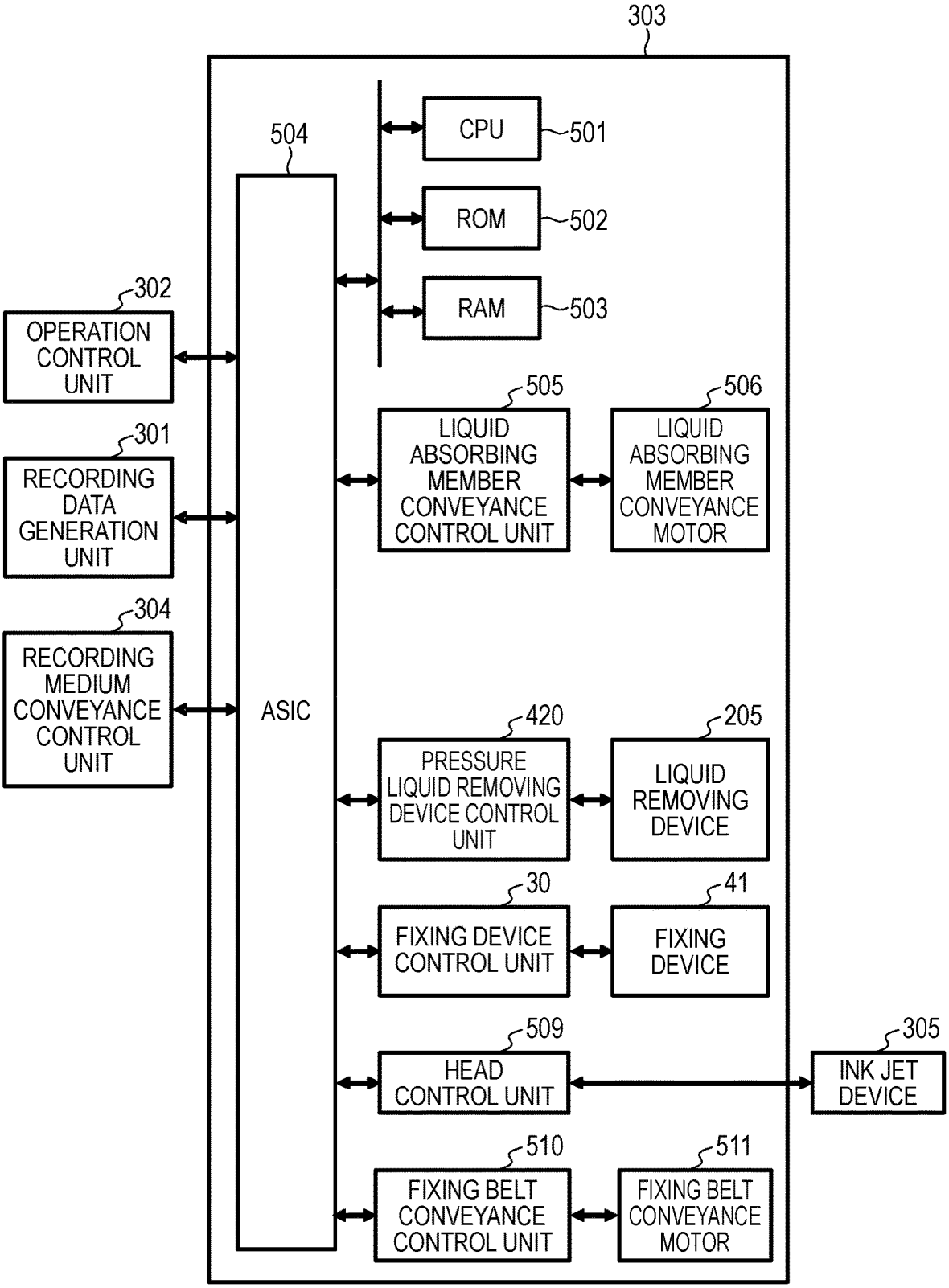
FIG. 8 is a block diagram of a printer control unit in the direct drawing type ink jet recording apparatus shown in FIG. 5.

FIG. 8 is a block diagram of the printer control unit in the direct drawing type ink jet recording apparatus in FIG. 5. The block diagram is substantially the same as the block diagram of the printer control unit in the transfer type ink jet recording apparatus in FIG. 7 except that the transfer body drive control unit 407 and the transfer body drive motor 408 are eliminated.

In other words, 501 is a CPU for controlling the whole printer, 502 is a ROM for storing a control program of the CPU, and 503 is a RAM for executing a program. 504 is an ASIC including a network controller, a serial IF controller, a controller for generating head data, a motor controller and the like. 505 is a liquid absorbing member conveyance control unit for driving a liquid absorbing member conveyance motor 506 and is controlled by a command from the ASIC 504 via a serial IF. 509 is a head control unit and performs final ejection data generation for the ink jet device 305 and drive voltage generation, for example. 510 is a fixing belt conveyance control unit for driving a fixing belt conveyance motor 511 and is controlled by a command from the ASIC 504 via a serial IF.

According to the present invention, an ink jet recording method and an ink jet recording apparatus capable of maintaining the glossiness immediately after fixation even when time passes can be provided.

EXAMPLES

The present embodiments will next be described in further detail with reference to examples and comparative examples. The present invention is not intended to be limited to the following examples without departing from the scope of the invention. In the following description in examples, "part" and "%" are based on mass unless otherwise noted.

Example 1

The transfer type ink jet recording apparatus in FIG. 1 was used to record images. The transfer body 101 in the example is fixed to the support member 102 with an adhesive. "Residual % by mass" or "remainder" is such an amount as to give a total of 100% by mass.

In the example, a PET sheet having a thickness of 0.5 mm was coated with a silicone rubber (KE12 manufactured by Shin-Etsu Chemical) into a thickness of 0.3 mm, and the resulting sheet was used as the elastic layer of the transfer body. Glycidoxypropyltriethoxysilane and methyltriethoxysilane were mixed at a molar ratio of 1:1, and the mixture was heated and refluxed to give a condensate. The condensate was mixed with a photocationic polymerization initiator (SP150 manufactured by ADEKA) to give a mixture. Atmospheric pressure plasma treatment was performed so that the elastic layer surface would have a contact angle with water of 10 degrees or less, and the above mixture was applied onto the elastic layer. The coating was subjected to UV irradiation (with a high-pressure mercury lamp, an integrated exposure amount of 5,000 mJ/cm$^2$) and to thermal curing (150° C., 2 hours) to form a film, yielding a transfer body 101 including the elastic body on which a surface layer having a thickness of 0.5 μm was formed.

In the structure, a double-sided adhesive tape, not shown in the drawings for simple explanation, was used between the transfer body 101 and the support member 102 for holding the transfer body 101. In the structure, the surface of the transfer body 101 was heated at 60° C. by a heating means not shown in the drawings.

The reaction liquid to be applied by the reaction liquid application unit 103 had the following formulation, and the application amount was 1 g/m$^2$.

| | |
|---|---|
| Glutaric acid | 21.0% by mass |
| Glycerol | 5.0% by mass |
| Surfactant (MEGAFACE (registered trademark) F444, manufactured by DIC Corporation) | 5.0% by mass |
| Ion-exchanged water | residual % by mass |

An ink was prepared by the following procedure.

(Preparation of Pigment Dispersion)

First, 10 parts of carbon black (Monarch (registered trademark) 1100, manufactured by Cabot), 15 parts of an aqueous resin solution (prepared by neutralizing a 20.0% by mass aqueous solution of a styrene-ethyl acrylate-acrylic acid copolymer having an acid value of 150 and a weight average molecular weight (Mw) of 8,000 with an aqueous potassium hydroxide) and 75 parts of pure water were mixed. The mixture was placed in a batch type vertical sand mill (manufactured by Aimex), and 200 parts of 0.3-mm zirconia beads were added. The mixture was dispersed for 5 hours while cooled with water. The dispersion liquid was centrifuged to remove coarse particles, and a black pigment dispersion having a pigment content of 20.0% by mass was prepared.

(Preparation of Resin Particle Dispersion)

First, 20 parts of ethyl methacrylate, 3 parts of 2,2'-azobis-(2-methylbutyronitrile) and 2 parts of n-hexadecane were mixed, and the mixture was stirred for 0.5 hours. The mixture was added dropwise to 75 parts of 8% by mass aqueous solution of styrene-butyl acrylate-acrylic acid copolymer (acid value: 130 mg KOH/g, weight average molecular weight (Mw): 7,000), and the whole was stirred for 0.5 hours. Next, the mixture was sonicated with a sonicator for 3 hours. Subsequently, the mixture was polymerized under a nitrogen atmosphere at 80° C. for 4 hours. The reaction mixture was cooled to room temperature and then filtered, giving a resin particle dispersion having a content of the resin particles of 25.0% by mass. Additionally, the content of the resin particle can be controlled by diluting or condensing the resin particle dispersion as necessary. The resin had a softening point of 90° C. The softening point was determined in accordance with "Determination of minimum film-forming temperature" in JIS K 6828-2. In other words, the resin dispersion was heated under an appropriate temperature gradient to determine the boundary temperature between a transparent region in which a film was formed and a region in which no film was formed. The lowest film-forming temperature of the resin dispersion was determined with a lowest film-forming temperature meter (trade name "MFFTB90", manufactured by RHOPOINT INSTRUMENTS).

(Preparation of Ink)

The resin particle dispersion and the pigment dispersion prepared above were mixed with the components shown below. The remainder of ion-exchanged water is such an amount that the total amount of all the components constituting the ink will be 100.0% by mass. The ink had a solid content of 10.0% by mass.

| | |
|---|---|
| Pigment | 4.0% by mass |
| Resin particles | 6.0% by mass |
| Glycerol | 7.0% by mass |
| Polyethylene glycol (number average molecular weight (Mn): 1,000) | 1.0% by mass |
| Surfactant (Acetylenol (registered trademark) E100, manufactured by Kawaken Fine Chemicals) | 0.5% by mass |
| Ion-exchanged water | remainder |

These components were thoroughly stirred and dispersed and then subjected to pressure filtration through a microfilter with a pore size of 3.0 μm (manufactured by Fujifilm), giving a black ink.

Figure 9:
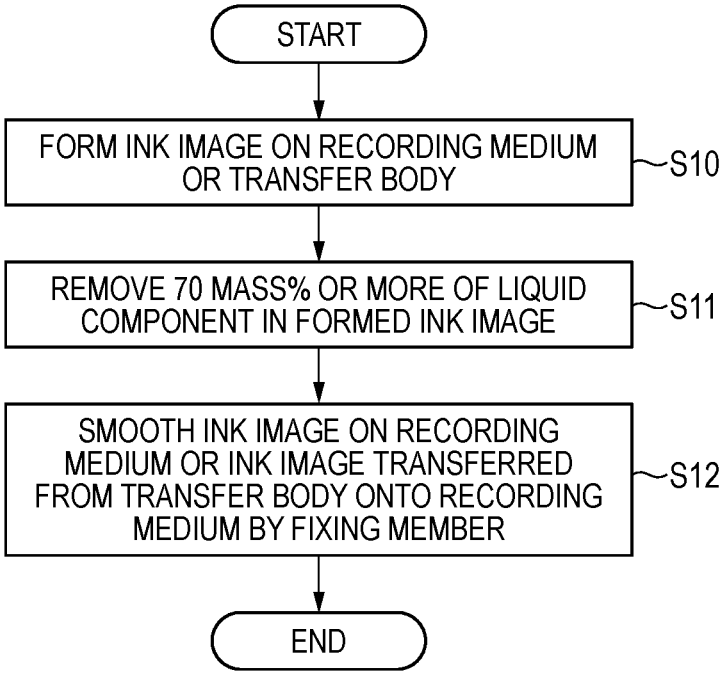
FIG. 9 is a flowchart of an ink jet recording method according to an embodiment of the present invention.

The reaction liquid was applied to the transfer body 101, and then an ink image was formed on the transfer body 101 by using the ink applying device 104 (ink image forming step, Step S10 in FIG. 9). The ink applying device 104 used was an ink jet recording head including an electrothermal converter for ejecting an ink on demand, and the ink application amount was 20 g/m$^2$.

Next, from the formed ink image, a liquid component was removed under pressure by using the liquid absorbing device 105 (liquid removing step, Step S11). The liquid absorbing conditions were such conditions as to remove 70% by mass or more of the liquid component as shown below. The ink image after liquid component removal was transferred to the recording medium 108 by using the pressing member 106 (transfer step). The liquid absorbing member 105*a* is controlled by conveyor rollers 105*c*, 105*d* and 105*e*, which extend and convey the liquid absorbing member, so as to have substantially the same speed as the movement speed of the transfer body 101. The recording medium 108 is conveyed by the recording medium delivery roller 107*a* and the recording medium winding roller 107*b* so as to have substantially the same speed as the movement speed of the transfer body 101. In the example, the conveyance speed was 0.5 m/s, and Aurora Coat Paper (manufactured by Nippon Paper Industries, a basis weight of 157 g/m$^2$) was used as the recording medium 108.

In the example, a porous PTFE having an average pore diameter of 0.2 μm was used as the liquid absorbing member 105*a*. The surface of the porous PTFEd a contact angle with water of 118°. The liquid absorbing member 105*a* had a Gurley value of 5 seconds.

The treatment liquid (wetting liquid) to be applied to the liquid absorbing member 105*a* before image contact had the following formula, and the application amount was 10 g/m$^2$.

| | |
|---|---|
| Glycerol | 10.0% by mass |
| Surfactant (product name: MEGAFACE F444, manufactured by DIC Corporation) | 5.0% by mass |
| Ion-exchanged water | residual % by mass |

In the example, the cloud point of the surfactant in the treatment liquid (wetting liquid) was determined by the following procedure.

First, 50 ml of the treatment liquid was prepared. The treatment liquid at room temperature was heated, and the heating temperature when the transparent treatment liquid was turned into a cloudy liquid in visual observation was regarded as the cloud point of the surfactant in the treatment liquid (wetting liquid).

As for the nip pressure between the transfer body 101 and the liquid absorbing member 105*a*, such a pressure is applied to the pressing member 105*b* as to give an average pressure (the average nip pressure) of 2.9 N/cm$^2$ (0.3 kgf/cm$^2$). The pressing member 105*b* used had a roller diameter of ϕ200 mm.

Next, the ink image on the recording medium 108 was smoothed by using the fixing device 41 (smoothing step, Step S12). In the example, Kapton (registered trademark, manufactured by DU PONT-TORAY Co., Ltd.) was used as the fixing belt 51. The arithmetic average roughness Ra of the surface of the fixing belt 51 was 0.07 μm. The surface temperature of the heat and pressure roller 52 was set at 150° C. that was not less than the softening point of resin particles in the ink, and the support roller 53 was used to apply a pressure of 15 kg/cm$^2$. The surface temperature of the fixing belt 51 immediately before contact with the recording medium was also 150° C.

With the cooler 55, the recording medium and the recorded image were cooled by blower fans to 25° C. that was less than the softening point of the resin particles. The surface temperature of the fixing belt 51 immediately after release of the recording medium was also 25° C. The fixing belt 51 was then released by the release roller 54, giving a final image. The surface temperature of the heat and pressure roller 52, the surface temperature of the fixing belt and the surface temperatures of the recording medium and the recorded image were measured with an infrared thermometer.

Example 2

Images were formed in the same manner as in Example 1 except that a pressure was applied to the pressing member 105*b* so that the average nip pressure between the transfer body 101 and the liquid absorbing member 105*a* would be 14.7 N/cm$^2$ (1.5 kgf/cm$^2$).

Example 3

Images were formed in the same manner as in Example 1 except that a pressure was applied to the pressing member 105*b* so that the average nip pressure between the transfer body 101 and the liquid absorbing member 105*a* would be 29.4 N/cm$^2$ (3.0 kgf/cm$^2$).

Example 4

Images were formed in the same manner as in Example 1 except that a pressure was applied to the pressing member 105*b* so that the average nip pressure between the transfer body 101 and the liquid absorbing member 105*a* would be 49 N/cm$^2$ (5.0 kgf/cm$^2$).

Example 5

Figure 3:
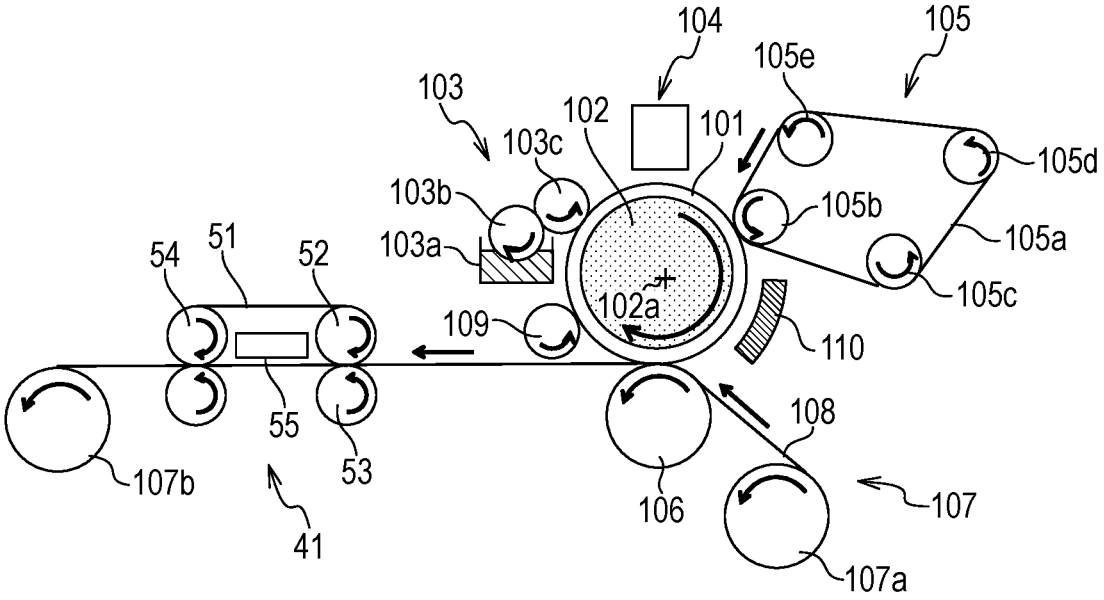
FIG. 3 is a schematic view showing an exemplary structure of a transfer type ink jet recording apparatus according to an embodiment of the present invention.

The transfer type ink jet recording apparatus in FIG. 3 was used to record images. The average nip pressure at the time of liquid absorption was 1.5 kgf/cm$^2$. The apparatus in Example 5 differs from the apparatus in FIG. 1 in an additional drying device (heater) 110 using warm air immediately after the liquid absorbing device. The drying device 110 has an effective length of 0.5 m and further dries, by warm air at 80° C., an ink image after liquid removal. The reaction liquid and the ink were prepared in the same manner as those used in the apparatus in FIG. 1 and are not specifically described. Example 5 reveals that one or more heating steps or liquid removing steps may be further included after the liquid removing step by the liquid absorbing device 105. The conditions of the image formation other than the above is the same as in Example 5.

Example 6

Images were formed in the same manner as in Example 5 except that an infrared heater was used as the drying device 110. Example 6 reveals that one or more heating steps or liquid removing steps may be further included after the liquid removing step by the liquid absorbing device 105.

Example 7

Figure 4:
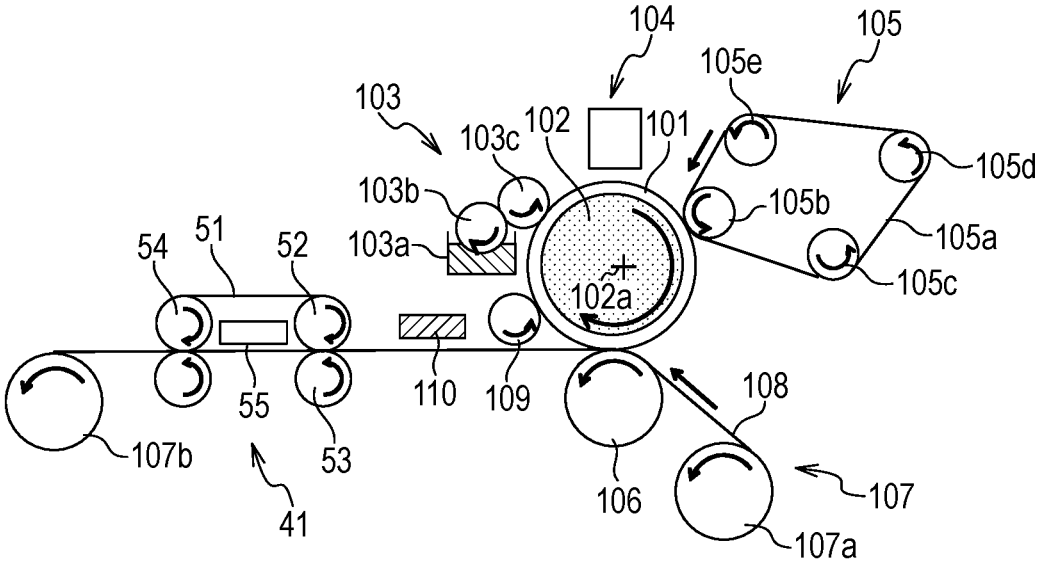
FIG. 4 is a schematic view showing an exemplary structure of a transfer type ink jet recording apparatus according to an embodiment of the present invention.

The transfer type ink jet recording apparatus in FIG. 4 was used to record images. The average nip pressure at the time of liquid absorption was 1.5 kgf/cm$^2$. The apparatus in Example 7 differs from the apparatus in FIG. 1 in an additional drying device (heater) 110 using warm air immediately after the transfer step. The drying device 110 has an effective length of 0.5 m and further dries an ink image by warm air at 80° C. The reaction liquid and the ink were prepared in the same manner as those used in the apparatus in FIG. 1 and are not specifically described. The conditions of the image formation other than the above is the same as in Example 5. Examples 6 and 7 reveal that an additional heating step or an additional liquid removing step may be included after the liquid removing step and before the smoothing step. In other words, when the liquid removing step by the liquid absorbing device 105 is regarded as a first liquid removing step, a heating step or second liquid removing step may be further included after the first liquid removing step and before the smoothing step. The second liquid removing step is a step of contacting porous body of the liquid absorbing member with the ink image to remove at least one part of the liquid component from the ink image.

Example 8

Images were formed in the same manner as in Example 1 except that the resin particle dispersion in Example 1 was concentrated, the ink formulation was changed as shown below, the solid content was 20.0% by mass, and the average nip pressure at the time of liquid absorption was 1.5 kgf/cm$^2$.

| | |
|---|---|
| Pigment | 4.0% by mass |
| Resin particles | 16.0% by mass |
| Glycerol | 7.0% by mass |
| Polyethylene glycol (number average molecular weight (Mn): 1,000) | 1.0% by mass |
| Surfactant (Acetylenol E100, manufactured by Kawaken Fine Chemicals) | 0.5% by mass |
| Ion-exchanged water | remainder |

Example 9

Images were formed in the same manner as in Example 8 except that the resin particle dispersion in Example 8 was further concentrated, the ink formulation was changed as shown below, and the solid content was 30.0% by mass.

| | |
|---|---|
| Pigment | 4.0% by mass |
| Resin particles | 26.0% by mass |
| Glycerol | 7.0% by mass |
| Polyethylene glycol (number average molecular weight (Mn): 1,000) | 1.0% by mass |
| Surfactant (Acetylenol E100, manufactured by Kawaken Fine Chemicals) | 15% by mass |
| Ion-exchanged water | remainder |

Example 10

The direct drawing type ink jet recording apparatus in FIG. 5 was used to record images. The reaction liquid and the ink used in the apparatus in FIG. 5 were prepared in the same manner as in Example 1 and are not specifically described.

The ink applying device (ink applying unit) 104 used was an ink jet head including an electrothermal converter for ejecting an ink on demand, and the ink application amount was 20 g/m$^2$.

The liquid absorbing member 205*a* is controlled by conveyor rollers 205*c*, 205*d*, 205*e*, 205*f* and 205*g*, which extend and convey the liquid absorbing member, so as to have substantially the same speed as the movement speed of the recording medium 208. The recording medium 208 is conveyed by the recording medium delivery roller 207*a* and the recording medium winding roller 207*b*. In the example, the conveyance speed was 0.5 m/s, and GLORIA PURE WHITE PAPER (manufactured by Gojo Paper, a basis weight of 210.0 g/m$^2$) was used as the recording medium 208.

In the example, a porous PTFE having an average pore diameter of 0.2 μm was used as the liquid absorbing member 205*a*. The surface of the porous PTFE had a contact angle with water of 118°. The liquid absorbing member 205*a* had a Gurley value of 5 seconds.

The treatment liquid (wetting liquid) to be applied to the liquid absorbing member 205*a* before image contact had the following formula, and the application amount was 10 g/m$^2$.

| | |
|---|---|
| Glycerol | 10.0% by mass |
| Surfactant (product name: MEGAFACE F444, manufactured by DIC Corporation) | 5.0% by mass |
| Ion-exchanged water | remainder |

In the example, the cloud point of the surfactant in the treatment liquid (wetting liquid) was determined by the following procedure. First, 50 ml of the treatment liquid was prepared. The treatment liquid at room temperature was heated, and the heating temperature when the transparent treatment liquid was turned into a cloudy liquid in visual observation was regarded as the cloud point of the surfactant in the treatment liquid (wetting liquid).

As for the nip pressure between the recording medium 208 and the liquid absorbing member 205*a*, such a pressure is applied to the pressing member 205*b* as to give an average pressure (the average nip pressure) of 2.9 N/cm$^2$ (0.3 kgf/cm$^2$). The pressing member 205*b* used had a roller diameter of ϕ200 mm.

In the example, Kapton (registered trademark, manufactured by DU PONT-TORAY Co., Ltd.) was used as the fixing belt 51. The arithmetic average roughness Ra of the surface of the fixing belt 51 was 0.07 μm. The surface temperature of the heat and pressure roller 52 was set at 150° C., and the support roller 53 was used to apply a pressure of 15 kg/cm$^2$. With the cooler 55, the recording medium and the recorded image were cooled by blower fans to 25° C. The fixing belt 51 was then released by the release roller 54, giving a final image. The surface temperature of the heat and pressure roller 52 and the surface temperatures of the recording medium and the recorded image were measured with an infrared thermometer.

Comparative Example 1

The transfer type ink jet recording apparatus in FIG. 3 was used to record images. No liquid removing device 105 was used but only the drying device (heater) 110 was used to remove the liquid component in the ink image. The reaction liquid and the ink were prepared in the same manner in Example 1 and are not specifically described. The conditions of the image formation other than the above is the same as in Example 5.

Comparative Example 2

The transfer type ink jet recording apparatus in FIG. 3 was used to record images. No liquid removing device 105 was used but only the drying device 110 was used to remove the liquid component in the ink image. The ink used had the following formulation. The reaction liquid was prepared in the same manner as in Example 1 and is not specifically described. The conditions of the image formation other than the above is the same as in Example 5.

| | |
|---|---|
| Pigment | 4.0% by mass |
| Resin particles | 6.0% by mass |
| Glycerol | 2.1% by mass |
| Polyethylene glycol (number average molecular weight (Mn): 1,000) | 0.3% by mass |
| Surfactant (Acetylenol E100, manufactured by Kawaken Fine Chemicals) | 0.2% by mass |
| Ion-exchanged water | remainder |

Comparative Example 3

Images were formed in the same manner as in Example 1 except that a pressure was applied to the pressing member 105*b* so that the average nip pressure between the transfer body 101 and the liquid absorbing member 105*a* would be 1.96 N/cm$^2$ (0.2 kgf/cm$^2$).

Comparative Example 4

Images were formed in the same manner as in Example 10 except that a pressure was applied to the pressing member 205*b* so that the average nip pressure between the recording medium 208 and the liquid absorbing member 205*a* would be 1.96 N/cm$^2$ (0.2 kgf/cm$^2$).

Comparative Example 5

Images were formed by using the ink jet recording apparatus in which the positions of the liquid removing device 105 and the drying device 110 were replaced so that the heating step and liquid removing step were carried out in this order in the transfer type ink jet recording apparatus in FIG. 3. The reaction liquid and the ink were prepared in the same manner in Example 1 and are not specifically described. The conditions of the image formation other than the above is the same as in Example 6.

(Liquid Removal Rate)

In the examples, the liquid removal rate was measured by the following procedure. First, the applied liquid amount contained in a reaction liquid and an ink applied onto the transfer body 101 or the recording medium 208 in the reaction liquid application step and the ink application step was calculated from the liquid component concentration, the amount of the applied reaction liquid, and the amount of the applied ink in each example. In the case of image formation without heating step before the liquid removing step as Examples 1 to 10 and Comparative Examples 3 to 4, this applied liquid amount was defined as the amount of the liquid component in the ink image just before the liquid removing step. Further, in the case of the image formation with heating step before the liquid removing step as Comparative Example 5, the amount of water in the ink image heated by the heating step was measured by means of the infrared moisture gauge (IRMA-2100S made by CHINO Inc.). Because all solvents except for water in the liquid component including in the ink image are not evaporated in this heating step, the total value of the amount of water measured by the infrared moisture gauge and the amount of the solvents other than water in the applied liquid amount is defined as the amount of the liquid component in the ink image just before the liquid removing step. Next, the transfer body 101 or the recording medium 208 after the liquid removing step was weighed, and the difference from the applied liquid amount was calculated as the removed liquid amount. The removed liquid amount was divided by the applied liquid amount to give the liquid removal rate. Concretely, in the case of the image formation without heating step after the liquid removing step as Examples 1 to 4, 8 to 10 and Comparative Examples 3 to 5, deduct the weight of the transfer member before applying the ink and reaction liquid from the weight of the transfer member after the liquid removing step to calculate the weight of the ink image just after the liquid removing step. Next, the amount of the liquid component in the ink image just after the liquid removing step by deducting the amount of the solid component of the ink from the weight of the ink image. Then, the removing rate of the liquid component in the liquid removing step was calculated from the amount of the liquid component in the ink image just after the liquid removing step and the amount of the applied liquid. Further, the amount of the liquid component just before the transfer step in Examples 1 to 4, 8 to 10 and Comparative Examples 3 to 5 was equal to the amount of the liquid component in the liquid removing step because of not-passing through the heating step. Similarly, the removing rate of the total liquid component in the liquid removing step and the heating step in Examples 1 to 4, and 8 to 10 and Comparative Examples 3 to 5 was estimated as equal to the removing rate of the liquid component in the liquid removing step. Further, in the case of image formation via heating step just after the liquid removing step as in Examples 5 to 7, the amount of the liquid component in just after the liquid removing step and the removing rate of the liquid component in the liquid removing step were calculated in the same manner as in Example 1 except for using the weight of the transfer body after the liquid removing step and before the heating step. Further, the amount of the liquid component just before the transfer step in Examples 5 to 7 was calculated by the same manner as in Example 1 except for using the weight of the transfer body after the liquid removing step and the heating step. Similarly, the removing rate of the total liquid component in the liquid removing step and the heating step in Examples 5 to 7 was calculated by the same manner as in Example 1 except for using the weight of the transfer body after the liquid removing step and the heating step.

(Glossiness Evaluation)

In the examples, the glossiness was evaluated by image clarity measurement. The image clarity was measured with an image clarity meter (manufactured by Suga Test Instruments, ICM-1T) as an image clarity C (2) (%). The glossiness of an image immediately after gloss application by the fixing device 41 was measured, then the image was allowed to stand in an environment at 25° C. and a relative humidity of 50% for 24 hours, and the glossiness was measured again. Based on the difference between the glossiness measured immediately after fixation and the glossiness measured after 24 hours ((glossiness immediately after fixation)−(glossiness after 24 hours)), the glossiness was evaluated. The criteria are as shown below.

A: The difference between the glossiness immediately after fixation and the glossiness after 24 hours is less than 3.

B: The difference between the glossiness immediately after fixation and the glossiness after 24 hours is not less than 3 and less than 6.

C: The difference between the glossiness immediately after fixation and the glossiness after 24 hours is not less than 6 and less than 10.

D: The difference between the glossiness immediately after fixation and the glossiness after 24 hours is not less than 10.

Table 1 shows the results of gloss changes in Examples and Comparative Examples. As shown in Table 1, the glossiness evaluation results in Examples 1 to 10 are A to C, and the glossiness changes are within the acceptable range. Particularly, it is presumed that in Examples 5 to 7 the liquid component in the ink images are further removed by the heating step after the liquid removing step to decrease the void in the ink image at the time of smoothing step to more suppress gloss changes. In contrast, in Comparative Example 1, a liquid absorbing member was not brought into contact in the liquid removing step, but water and a low-boiling solvent contained in the ink image were evaporated by warm air. The glossiness evaluation result in the Comparative Example 1 is D. This is because, in Comparative Example 1, the ink image did not come into contact with the liquid absorbing member, unlike Example 1, to give many voids in the image after transfer, and the glossiness changed as time passed.

In Comparative Example 2, a liquid absorbing member was not brought into contact in the liquid removing step, but water and a low-boiling solvent contained in the ink were evaporated by warm air as with Comparative Example 1. In Comparative Example 2, the solvent formulation in the ink after drying was adjusted to be the same as in Example 1, unlike Comparative Example 1. The gloss change in Comparative Example 2 exceeded a visual limit, and this indicates that even when the remaining solvent formulation is the same, pressing and compressing of an ink image by a porous body are essential to maintain gloss.

In Comparative Example 3, the liquid component was insufficiently removed, and the solid components in the ink layer were insufficiently compressed. Hence, as time passed, voids were formed, and the glossiness changed.

Comparative Example 4 used a direct drawing type ink jet recording apparatus. As with Comparative Example 3, the liquid component was insufficiently removed, and the solid components in the ink layer were insufficiently compressed. Hence, as time passed, voids were formed, and the glossiness changed.

The above results reveal that when images are recorded by the method of the invention, such highly glossy images as silver halide photographs can be maintained.

TABLE 1

| Example No. | Ink jet recording apparatus | Liquid removing step | Heating step | Average nip pressure between liquid absorbing member and transfer body (kgf/cm$^2$) | Ink solid content (mass %) | Applied Liquid amount (g/m$^2$) |
|---|---|---|---|---|---|---|
| Example 1 | Transfer type | Absorbing member contact | | 0.3 | 10.0 | 18.8 |
| Example 2 | Transfer type | Absorbing member contact | | 1.5 | 10.0 | 18.8 |
| Example 3 | Transfer type | Absorbing member contact | | 3.0 | 10.0 | 18.8 |
| Example 4 | Transfer type | Absorbing member contact | | 5.0 | 10.0 | 18.8 |
| Example 5 | Transfer type | Absorbing member contact | Warm air drying | 1.5 | 10.0 | 18.8 |
| Example 6 | Transfer type | Absorbing member contact | Infrared light drying | 1.5 | 10.0 | 18.8 |
| Example 7 | Transfer type | Absorbing member contact | Warm air drying | 1.5 | 10.0 | 18.8 |
| Example 8 | ransfer type | Absorbing member contact | | 1.5 | 20.0 | 16.8 |
| Example 9 | Transfer type | Absorbing member contact | | 1.5 | 30.0 | 14.8 |
| Example 10 | Direct drawing type | Absorbing member contact | | 0.3 | 10.0 | 18.8 |
| Comparative Example 1 | Transfer type | | Warm air drying | — | 10.0 | 18.8 |
| Comparative Example 2 | Transfer type | | Warm air drying | — | 10.0 | 18.8 |
| Comparative Example 3 | Transfer type | Absorbing member contact | | 0.2 | 10.0 | 18.8 |
| Comparative Example 4 | Direct drawing type | Absorbing member contact | | 0.2 | 10.0 | 18.8 |
| Comparative Example 5 | Transfer type | Absorbing member contact | Infrared light drying | 0.3 | 10.0 | 18.8 |

TABLE 1-continued

| Example No. | Liquid component amount just before liquid removing step ($g/m^2$) | Liquid component amount just after liquid removing step ($g/m^2$) | Liquid component amount just before transfer step ($g/m^2$) | Liquid component removing rate in liquid removing step (mass %) | Total liquid component removing rate in liquid removing step and heating step (mass %) | Gloss change |
|---|---|---|---|---|---|---|
| Example 1 | 18.8 | 5.6 | 5.6 | 70 | 70 | C |
| Example 2 | 18.8 | 4.7 | 4.7 | 75 | 75 | C |
| Example 3 | 18.8 | 3.8 | 3.8 | 80 | 80 | B |
| Example 4 | 18.8 | 2.8 | 2.8 | 85 | 85 | A |
| Example 5 | 18.8 | 4.7 | 3.8 | 75 | 80 | A |
| Example 6 | 18.8 | 4.7 | 3.8 | 75 | 80 | A |
| Example 7 | 18.8 | 4.7 | 2.8 | 75 | 85 | A |
| Example 8 | 16.8 | 4.2 | 4.2 | 75 | 75 | B |
| Example 9 | 14.8 | 3.7 | 3.7 | 75 | 75 | B |
| Example 10 | 18.8 | 5.6 | | 70 | 70 | B |
| Comparative Example 1 | | | 5.6 | | 70 | D |
| Comparative Example 2 | | | 5.6 | | 70 | D |
| Comparative Example 3 | 18.8 | 6.6 | 6.6 | 65 | 65 | D |
| Comparative Example 4 | 18.8 | 6.6 | | 65 | 65 | D |
| Comparative Example 5 | 5.2 | 3.1 | 3.1 | 40 | 40 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131277, filed Jul. 4, 2017, which is hereby incorporated by reference herein in its entirety.

What is claimed is:

1. An ink jet recording method comprising:

a step of applying a reaction liquid onto a transfer body;

an ink image forming step of applying, onto the transfer body, an ink containing a resin having a softening point and a liquid component to form an ink image;

a liquid removing step of bringing a porous body included in a liquid absorbing member into contact with the ink image on the transfer body to remove at least some of the liquid component from the ink image;

a transfer step of transferring the ink image from which at least some of the liquid component is removed, from the transfer body to a recording medium; and a smoothing step of bringing a fixing member into contact with the ink image on the recording medium, heating and pressing the ink image at a temperature not less than the softening point of the resin to smooth a surface of the ink image, and releasing the heated and pressed ink image from the fixing member at a temperature less than the softening point of the resin, wherein in the liquid removing step, a removal rate of the liquid component is 70% by mass or more.

2. The ink jet recording method according to claim 1, wherein in the liquid removing step, the porous body included in the liquid absorbing member is brought into contact with the ink image under pressure, and the pressure is 2.9 $N/cm^2$ or more to 98.1 $N/cm^2$ or less.

3. The ink jet recording method according to claim 2, wherein in the liquid removing step, the porous body included in the liquid absorbing member is brought into contact with the ink image under pressure, and the pressure is 14.7 $N/cm^2$ or more to 98.1 $N/cm^2$ or less.

4. The ink jet recording method according to claim 1, wherein when the liquid removing step is regarded as a first liquid removing step, a second liquid removing step is further included after the first liquid removing step and before the smoothing step.

5. The ink jet recording method according to claim 1, further comprising a heating step of heating the ink image after the liquid removing step.

6. The ink jet recording method according to claim 1, wherein in the heating step, the ink image after the liquid removing step is heated by warm air or infrared light.

7. The ink jet recording method according to claim 1, wherein in the liquid removing step, the removal rate of the liquid component is 70% by mass or more and 100% by mass or less.

8. The ink jet recording method according to claim 1, wherein the reaction liquid includes at least one selected from the group consisting of polyvalent metal ions, cationic resins, and organic acids.

9. The ink jet recording method according to claim 1, wherein the resin is at least one selected from the group consisting of acrylic resins and urethane resins.

10. The ink jet recording method according to claim 1, wherein the liquid component is at least one selected from the group consisting of water and organic solvents.

11. The ink jet recording method according to claim 1, wherein the liquid absorbing member has a belt shape.

12. The ink jet recording method according to claim 1, wherein a surface temperature of the fixing member before contact with the recording medium is 100° C. or more to 280° C. or less.

13. The ink jet recording method according to claim 1, wherein a surface temperature of the fixing member after the release of the recording medium is 30° C. or more to 65° C. or less.

14. The ink jet recording method according to claim 1, wherein the smoothing step further comprises cooling the fixing member.

15. An ink jet recording method comprising:

a step of applying a reaction liquid onto a recording medium:

an ink image forming step of applying, onto the recording medium, an ink containing a resin having a softening point and a liquid component to form an ink image;

a liquid removing step of bringing a porous body included in a liquid absorbing member into contact with the ink image on the recording medium to remove at least some of the liquid component from the ink image; and a smoothing step of bringing a fixing member into contact with the ink image from which at least some of the liquid component is removed on the recording medium, heating and pressing the ink image at a temperature not less than the softening point of the resin to smooth a surface of the ink image, and releasing the heated and pressed ink image from the fixing member at a temperature less than the softening point of the resin, wherein in the liquid removing step, a removal rate of the liquid component is 70% by mass or more.

16. The ink jet recording method according to claim 15, wherein the smoothing step further comprises cooling the fixing member.

17. An ink jet recording apparatus comprising:

a transfer body;

a reaction liquid applying unit configured to apply a reaction liquid onto the transfer body;

an ink image forming unit configured to apply, onto the transfer body, an ink containing a resin having a softening point and a liquid component to form an ink image;

a liquid absorbing unit including a liquid absorbing member having a porous body configured to come into contact with the ink image on the transfer body to absorb at least some of the liquid component from the ink image;

a transfer unit configured to transfer the ink image from which at least some of the liquid component is removed, from the transfer body to a recording medium; and a fixing unit including a fixing member configured to come into contact with the ink image on the recording medium and to smooth the ink image by heat and pressure, wherein the fixing unit includes a heating unit configured to heat the fixing member to a temperature not less than the softening point of the resin and a cooling and releasing unit configured to cool the fixing member to a temperature less than the softening point of the resin and to release the ink image from the fixing member, and wherein the liquid absorbing unit is configured to absorb and remove such an amount of the liquid component as to give a removal rate of 70% by mass or more of the liquid component in the ink image.

18. An ink jet recording apparatus comprising:

a reaction liquid applying unit configured to apply a reaction liquid onto a recording medium;

an ink image forming unit configured to apply, onto the recording medium, an ink containing a resin having a softening point and a liquid component to form an ink image;

a liquid absorbing unit including a liquid absorbing member having a porous body configured to come into contact with the ink image on the recording medium to absorb at least some of the liquid component from the ink image; and a fixing unit including a fixing member configured to come into contact with the ink image on the recording medium and to smooth the ink image by heat and pressure, wherein the fixing unit includes a heating unit configured to heat the fixing member to a temperature not less than the softening point of the resin and a cooling and releasing unit configured to cool the fixing member to a temperature less than the softening point of the resin and to release the ink image from the fixing member, and wherein the liquid absorbing unit is configured to absorb and remove such an amount of the liquid component as to give a removal rate of 70% by mass or more of the liquid component in the ink image.

* * * * *